US007828146B2

(12) United States Patent
Frayne

(10) Patent No.: US 7,828,146 B2
(45) Date of Patent: Nov. 9, 2010

(54) INFLATABLE CONTAINERS

(75) Inventor: Shawn Frayne, Tampa, FL (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 1273 days.

(21) Appl. No.: 11/372,684

(22) Filed: Mar. 10, 2006

(65) Prior Publication Data

US 2006/0201960 A1 Sep. 14, 2006

Related U.S. Application Data

(60) Provisional application No. 60/661,314, filed on Mar. 12, 2005.

(51) Int. Cl.
*B65D 81/02* (2006.01)

(52) U.S. Cl. ..... 206/522; 137/511

(58) Field of Classification Search ..... 206/522; 137/511, 843, 844

See application file for complete search history.

(56) References Cited

U.S. PATENT DOCUMENTS

| | | | | |
|---|---|---|---|---|
| 3,584 | A | 5/1844 | DeLiancourt | |
| 396,242 | A | 1/1889 | Simon | |
| 981,788 | A | 1/1911 | Nekarda | |
| 998,522 | A | 1/1911 | Jonata | |
| 1,116,393 | A | 11/1914 | Despot | |
| 1,315,190 | A | 9/1919 | Nekarda | |
| 2,118,165 | A | 5/1938 | Christopher et al. | |
| 3,017,642 | A | 1/1962 | Rosenberg et al. | |
| 3,138,248 | A | 6/1964 | Abbott | |
| 3,339,218 | A | 9/1967 | Stamberger | |
| 3,340,669 | A | 9/1967 | Farquharson | |
| 3,378,864 | A | 4/1968 | Cornes | |
| 3,389,534 | A | 6/1968 | Pendleton | |
| 3,462,917 | A | 8/1969 | Nakashima | |
| 3,533,113 | A | 10/1970 | Stamberger | |
| 3,643,268 | A | 2/1972 | Stamberger | |
| 3,747,298 | A | 7/1973 | Lieberman | |
| 3,808,981 | A | 5/1974 | Shaw | |
| 3,829,918 | A | 8/1974 | Stamberger | |
| 3,898,703 | A * | 8/1975 | Stamberger | 5/655.3 |
| 3,938,298 | A | 2/1976 | Luhman et al. | |
| 3,983,678 | A | 10/1976 | Bogler et al. | |
| 4,049,854 | A | 9/1977 | Casey et al. | |
| 4,106,733 | A | 8/1978 | Walitalo | |
| 4,106,734 | A | 8/1978 | Walitalo | |
| 4,240,556 | A | 12/1980 | Field | |
| 4,246,672 | A | 1/1981 | Fujiyama et al. | |
| 4,262,472 | A | 4/1981 | Soeda et al. | |

(Continued)

FOREIGN PATENT DOCUMENTS

| | | |
|---|---|---|
| DE | 40 07 128 A1 | 4/1991 |

(Continued)

*Primary Examiner*—Jacob K Ackun, Jr.
(74) *Attorney, Agent, or Firm*—Thomas C. Lagaly

(57) ABSTRACT

An inflatable container generally includes a flexible housing having an interior cavity and a flexible valve in operative association with the housing, wherein, when a first force is exerted on the housing and a second force is exerted on the valve, or the valve is attached to an external object such as another container, the housing and the valve each undergo a change in shape to draw fluid from the ambient environment, through the valve, and into the interior cavity.

9 Claims, 26 Drawing Sheets

U.S. PATENT DOCUMENTS

| | | | | |
|---|---|---|---|---|
| 4,340,626 | A | | 7/1982 | Rudy |
| 4,415,398 | A | | 11/1983 | Ottaviano |
| 4,504,989 | A | | 3/1985 | Maltz |
| 4,516,949 | A | | 5/1985 | Schwartz |
| RE32,018 | E | | 11/1985 | Domke et al. |
| 4,652,173 | A | | 3/1987 | Kallestad |
| 4,674,532 | A | | 6/1987 | Koyanagi |
| 4,708,167 | A | | 11/1987 | Koyanagi |
| 4,819,899 | A | | 4/1989 | Weil |
| 4,847,126 | A | | 7/1989 | Yamashiro et al. |
| 4,850,912 | A | | 7/1989 | Koyanagi |
| 4,917,646 | A | | 4/1990 | Kieves |
| 4,924,919 | A | | 5/1990 | Oyler |
| 4,974,393 | A | | 12/1990 | Rich et al. |
| 5,020,750 | A | | 6/1991 | Vrooman et al. |
| 5,079,778 | A | * | 1/1992 | Sloot ..... 2/69 |
| 5,125,604 | A | | 6/1992 | Vrooman et al. |
| 5,205,109 | A | | 4/1993 | Conway |
| 5,254,074 | A | | 10/1993 | Landers et al. |
| 5,272,856 | A | | 12/1993 | Pharo |
| 5,339,602 | A | | 8/1994 | Landers et al. |
| 5,447,235 | A | | 9/1995 | Pharo |
| 5,450,638 | A | * | 9/1995 | Johnson ..... 5/655.3 |
| 5,454,642 | A | | 10/1995 | De Luca |
| 5,469,592 | A | | 11/1995 | Johnson |
| 5,469,966 | A | | 11/1995 | Boyer |
| 5,535,888 | A | | 7/1996 | De Luca |
| 5,670,013 | A | | 9/1997 | Huang et al. |
| 5,690,228 | A | | 11/1997 | DeMatteis |
| 5,693,163 | A | | 12/1997 | Hoover et al. |
| 5,711,691 | A | | 1/1998 | Damask et al. |
| 5,755,328 | A | | 5/1998 | DeLuca |
| 5,788,078 | A | | 8/1998 | Fuss |
| 5,806,572 | A | | 9/1998 | Voller |
| 5,830,780 | A | | 11/1998 | Dennison et al. |
| 5,852,889 | A | | 12/1998 | Rinaldi |
| 5,873,215 | A | | 2/1999 | Aquarius et al. |
| 5,899,325 | A | | 5/1999 | Bertram et al. |
| 5,921,830 | A | | 7/1999 | Shoaff, III |
| 5,937,614 | A | | 8/1999 | Watkins et al. |
| 5,938,877 | A | | 8/1999 | Schram |
| 5,942,076 | A | | 8/1999 | Salerno et al. |
| 6,015,047 | A | | 1/2000 | Greenland |
| RE36,759 | E | | 7/2000 | Hoover et al. |
| 6,170,227 | B1 | | 1/2001 | Kovacs et al. |
| 6,199,349 | B1 | | 3/2001 | Lerner |
| 6,209,286 | B1 | | 4/2001 | Perkins et al. |
| 6,217,689 | B1 | | 4/2001 | Gehret |
| 6,276,532 | B1 | | 8/2001 | Sperry et al. |
| 6,341,473 | B1 | | 1/2002 | Kovacs et al. |
| 6,394,897 | B1 | | 5/2002 | Togami |
| 6,423,166 | B1 | | 7/2002 | Simhaee |
| 6,431,938 | B1 | | 8/2002 | Carlton et al. |
| 6,494,756 | B2 | | 12/2002 | Michaud et al. |
| 6,561,236 | B1 | | 5/2003 | Sperry et al. |
| 6,582,800 | B2 | | 6/2003 | Fuss et al. |
| 6,598,373 | B2 | | 7/2003 | Sperry et al. |
| 6,605,169 | B2 | | 8/2003 | Perkins et al. |
| 6,635,145 | B2 | | 10/2003 | Cooper |
| 6,651,406 | B2 | | 11/2003 | Sperry et al. |
| 6,659,150 | B1 | | 12/2003 | Perkins et al. |
| 6,672,033 | B2 | | 1/2004 | Brown |
| 6,673,001 | B2 | | 1/2004 | Toth |
| 6,682,622 | B2 | | 1/2004 | Matarasso |
| 6,751,926 | B1 | | 6/2004 | Cooper |
| 6,758,026 | B2 | | 7/2004 | Davey |
| 6,786,022 | B2 | | 9/2004 | Fuss et al. |
| 6,804,933 | B2 | | 10/2004 | Sperry et al. |
| 6,827,099 | B2 | | 12/2004 | Tanaka et al. |
| 6,920,980 | B2 | * | 7/2005 | Hwang et al. ..... 206/470 |
| RE39,408 | E | * | 11/2006 | Wang ..... 5/709 |
| 2004/0045090 | A1 | * | 3/2004 | Tsai ..... 5/709 |
| 2005/0046266 | A1 | * | 3/2005 | Schiebl ..... 297/452.41 |
| 2005/0124445 | A1 | * | 6/2005 | Veilleux et al. ..... 473/593 |

FOREIGN PATENT DOCUMENTS

| | | | |
|---|---|---|---|
| DE | 10127077 | | 12/2002 |
| FR | 2763912 | | 12/1998 |
| GB | 2 020 409 | | 11/1979 |
| GB | 2 106 779 | A | 4/1983 |
| GB | 2 365 342 | | 2/2002 |
| WO | 96/14783 | | 5/1996 |
| WO | 99/66817 | | 12/1999 |

* cited by examiner

INFLATABLE CONTAINERS

This Application claims the benefit from U.S. Provisional Application No. 60/661,314, filed Mar. 12, 2005, the disclosure of which is hereby incorporated herein by reference thereto.

BACKGROUND OF THE INVENTION

The present invention relates to inflatable containers and, more particularly, to self-inflating and self-sealing containers that do not require a mechanized apparatus to effect inflation and sealing of such containers.

Inflated containers are commonly used as cushions to package items, either by wrapping the items in the cushions and placing the wrapped items in a shipping carton, or by simply placing one or more inflated containers inside of a shipping carton along with an item to be shipped. The cushions protect the packaged item by absorbing impacts that may otherwise be fully transmitted to the packaged item during transit, and also restrict movement of the packaged item within the carton to further reduce the likelihood of damage to the item.

A wide variety of machines for forming inflated containers are available. Such machines generally inflate and seal the containers at the packaging site, starting with a web of flexible material, e.g., thermoplastic film. The web is segregated into individual containers, either before or during the inflation process, i.e., the individual containers are formed in the web prior to delivery to the packaging site or by the machine at the packaging site as part of the inflation and sealing process. The machine inflates each container with air or other fluid, and then seals the fluid within the containers.

Like all machinery, such 'inflate-and-seal' machines entail a capital expense and require frequent maintenance to keep the machine operating properly. While these drawbacks may be acceptable for large-scale packaging operations, they can be highly disadvantageous in small-scale packaging environments such as, e.g., small businesses or homes.

Accordingly, there is a need in the art for an inflatable container that can produce inflated packaging cushions without the need for an inflate-and-seal machine.

SUMMARY OF THE INVENTION

Those needs are met by the present invention, which, in one aspect, provides an inflatable container, comprising:

a) a flexible housing having an interior cavity, the housing adapted to undergo at least one change in shape; and b) a flexible valve in operative association with the housing, the valve adapted to undergo at least one change in shape to provide fluid communication between (1) the interior cavity, and (2) the ambient environment in which the container is located, wherein, when a first force is exerted on the housing and a second force is exerted on the valve, the housing and the valve each undergo a change in shape to draw fluid from the ambient environment, through the valve, and into the interior cavity.

Another aspect of the present invention pertains to a method for inflating a container, comprising:

a) providing an inflatable container as described above;

b) exerting a first force on the flexible housing to change the shape thereof; and c) exerting a second force on the flexible valve to change the shape thereof, whereby, the housing and the valve draw fluid from the ambient environment, through the valve, and into the interior cavity.

A further aspect of the invention relates to a plurality of connected inflatable containers, wherein each container is as described above and further includes at least one connector that attaches the housing to a housing of another inflatable container in the plurality of connected inflatable containers.

Another aspect of the invention is directed to an inflatable container system, comprising:

a) an inflatable container as described above; and b) a support structure on which the container is mounted.

An additional aspect of the invention pertains to a method for inflating a container, comprising:

a) providing an inflatable container as described above;

b) mounting the container on a support structure such that the container can move on the support structure;

c) moving the container on the support structure to exert a first force on the flexible housing to change the shape thereof; and d) exerting a second force on the flexible valve to change the shape thereof, whereby, the housing and the valve draw fluid from the ambient environment, through the valve, and into the interior cavity.

An alternative inflatable container in accordance with the present invention comprises:

a) a flexible housing having an interior cavity, the housing adapted to undergo at least one change in shape; and b) a flexible valve attached to the housing, the valve adapted to be further attached to an object external to the housing and to undergo at least one change in shape to provide fluid communication between (1) the interior cavity, and (2) the ambient environment in which the container is located, wherein, when the valve is attached to an external object and a force is exerted on the housing, the housing and the valve each undergo a change in shape to draw fluid from the ambient environment, through the valve, and into the interior cavity.

A related further aspect of the invention is directed to a plurality of connected inflatable containers, each container comprising:

a) a flexible housing having an interior cavity, the housing adapted to undergo at least one change in shape;

b) a flexible valve attached to the housing, the valve adapted to undergo at least one change in shape to provide fluid communication between (1) the interior cavity, and (2) the ambient environment in which the container is located; and c) at least one connector that attaches the flexible valve to a flexible valve of another inflatable container in the plurality of connected inflatable containers, wherein, when a force is exerted on the housing, the housing and the valve each undergo a change in shape to draw fluid from the ambient environment, through the valve, and into the interior cavity.

Advantageously, such containers require no mechanized apparatus to effect their inflation and sealing. Instead, the containers are self-inflating and self-sealing, and are constructed of flexible materials that are generally inexpensive and require a minimal amount of storage space.

These and other aspects and features of the invention may be better understood with reference to the following description and accompanying drawings.

BRIEF DESCRIPTION OF THE DRAWINGS

FIGS. 4A-9B collectively illustrate the separate steps preferably taken in the assembly and joining of the various components of the inflatable container. More specific descriptions of these figures are as follows:

FIG. 4A is an exploded perspective view of the components that comprise a flexible valve and leading eyelet tabs of the inflatable container.

FIG. 9B is a collapsed perspective view of the sub-assemblies illustrated in FIG. 9A, illustrating the location of heat seal joints between the sub-assemblies.

DETAILED DESCRIPTION OF THE INVENTION

Figure 1:
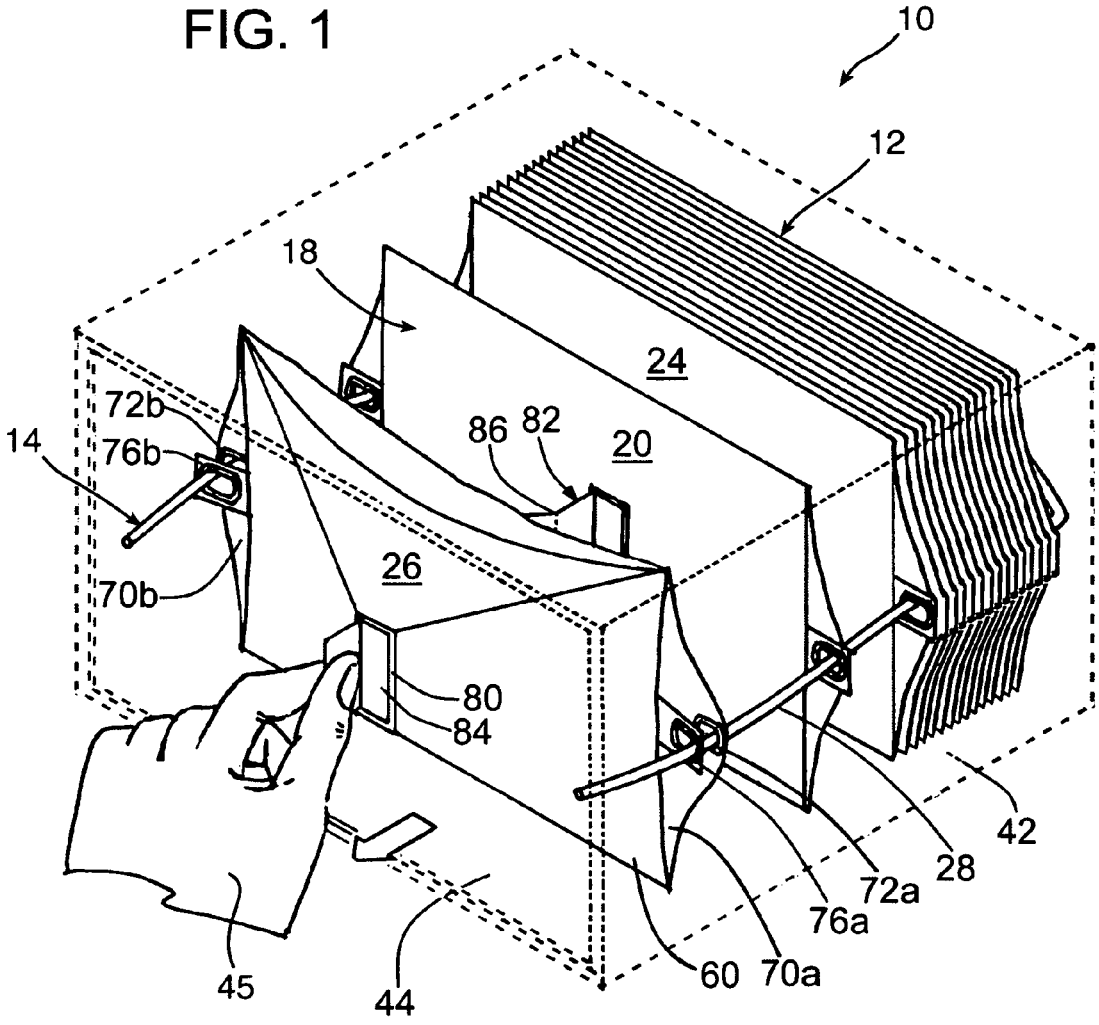
FIG. 1 is a perspective view of a plurality of connected inflatable containers positioned on a support structure. This figure further illustrates the manner of operation of the present invention through the depiction of an inflatable container undergoing inflation.

With general reference to FIGS. 1-28, one aspect of the present invention pertains to an inflatable container (12, 135) comprising:

a) a flexible housing (18, 143) having an interior cavity (83, 145), the housing adapted to undergo at least one change in shape; and b) a flexible valve (63, 120) in operative association with the housing (18, 143), the valve adapted to undergo at least one change in shape to provide fluid communication between (1) the interior cavity (83, 145), and (2) the ambient environment in which the container (12, 135) is located, wherein, when a first force (85, 157) is exerted on the housing (18, 143) and a second force (87) is exerted on the valve (63, 120), the housing and the valve each undergo a change in shape to draw fluid from the ambient environment, through the valve, and into the interior cavity (83, 145).

As used herein, the term "flexible" refers to an object that has the ability to change into a large variety of determinate and indeterminate shapes without damage thereto in response to the action of an applied force, and return to its general original shape when the applied force is removed.

In some embodiments, the flexible housing (18, 143) may comprise a pair of juxtaposed film panels (60/62; 144/146), wherein the change in shape of the housing comprises movement of one film panel relative to the other film panel, e.g., moving one panel away the other panel or moving both away from each other.

Similarly, the flexible valve (63, 120) may comprise a pair of juxtaposed film panels (64/66; 148/150), wherein the change in shape of the valve comprises movement of one film panel relative to the other film panel to form a channel (e.g., 81) between the panels.

One embodiment of an inflatable container in accordance with the present invention is illustrated in FIG. 1. More specifically, FIG. 1 depicts an inflatable container system 10, comprising a plurality of inflatable containers 12 and a support structure 14. In the presently illustrated embodiment, inflatable containers 12 are adapted for use as packing cushions, including un-inflated packing cushion 20, a stack of un-inflated packing cushions 24, and a packing cushion undergoing inflation 26, all of which are identical in construction and differ only in their states of inflation. Each packing cushion has two valve openings 70*a* and 70*b* (see FIG. 27) through which air can flow into the packing cushion via a self-sealing flexible valve, which will be described in more detail shortly. Near the valve openings 70*a* and 70*b*, a guide track 28 or other support structure may be fed through leading and trailing eyelets 76*a*-76*b* and 72*a*-72*b*, respectively.

Additionally, each cushion may be connected to neighboring cushions by connectors, such as a connector 82. Connector 82 may be perforated at a connector perforation 86. When the connector 82 is torn at perforation 86, fully inflated packing cushions (not pictured) may be separated and a detached connector 84 will remain affixed to a reinforcement patch 80, which itself is affixed to a first housing panel 60 of the packing cushion.

Each component of the inflatable cushions, including the flexible housing 18 and flexible valve 63, may, in general, comprise any flexible material that can enclose a fluid as herein described, including various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from $C_3$ to $C_{20}$ alpha-olefins, such as 1-butene, 1-pentene, 1-hexene, 1-octene, methyl pentene and the like, in which the polymer molecules comprise long chains with relatively few side chain branches, including linear low density polyethylene (LLDPE), linear medium density polyethylene (LMDPE), very low density polyethylene (VLDPE), and ultra-low density polyethylene (ULDPE). Various other materials are also suitable such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known coextrusion process by melting the component polymer(s) and extruding or coextruding them through one or more flat or annular dies. Composite, e.g., multilayered, materials may be employed to provide a variety of additional characteristics such as durability, enhanced gas-barrier functionality, etc.

Figure 2:
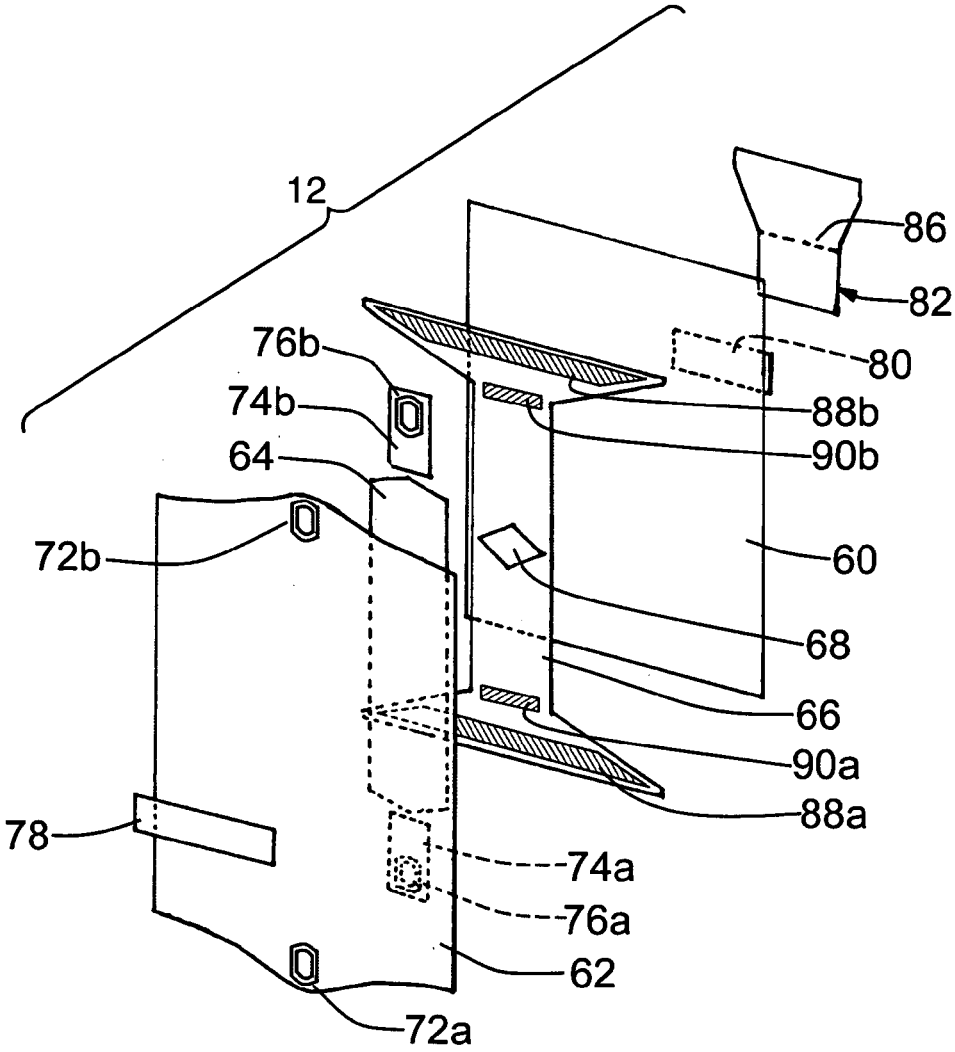
FIG. 2 is an exploded perspective view of an inflatable container of the present invention, illustrating the relative arrangements of all inflatable container components.
Figure 3:
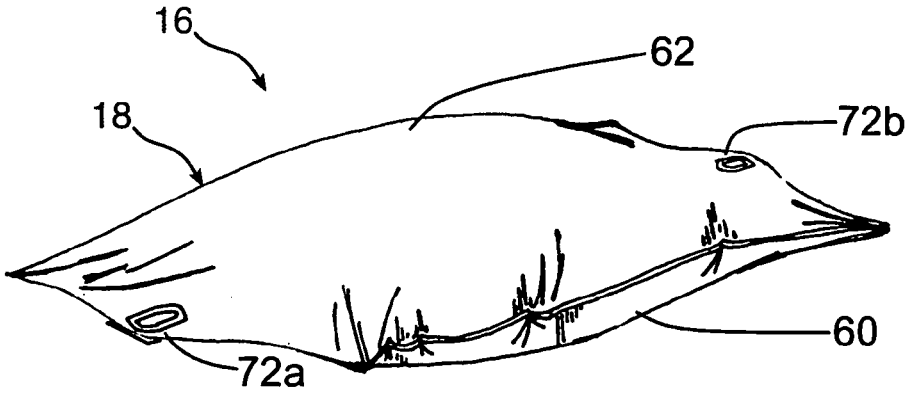
FIG. 3 is a simplified perspective view of the inflatable container after the inflatable container has been inflated.

FIG. 2 shows an exploded perspective view of a packing cushion in accordance with the present invention; this view illustrates the relative arrangements of all of the components of the packing cushion. FIG. 3 illustrates a simplified perspective view of an assembled, inflated packing cushion 16. These two figures, when viewed in conjunction, demonstrate that a first housing panel 60 and a second housing panel 62 may together comprise a flexible housing 18 for each of the inflatable containers 12.

As shown in FIGS. 2 and 4, the inflatable containers 12 also include a flexible valve 63, which may be formed from a first valve panel 66 and a second valve panel 64, and may be wholly or partially contained within the flexible housing 18 of the container 12.

When the inflatable containers 12 are used as packing cushions, the outer surface of the flexible housing 18 of the cushion will typically be in direct contact with the articles being shipped, and may therefore be subject to considerable abuse. The flexible valve 63, conversely, will generally be almost completely protected within the flexible housing 18 of the cushion and is therefore shielded from such damaging external influences. That being the case, the flexible housing 18 of the cushion may be constructed of a thicker material than that used for the flexible valve 63. For example, in order to reduce the possibility of rupture to the flexible housing of the cushion, first housing panel 60 and second housing panel 62 may each be constructed from a polyolefin film having a thickness ranging from about 0.5 to about 10 mils, such as, e.g., from about 1 to about 8 mils, about 2 to about 6 mils, about 2 to about 4 mils, etc. Because, in this embodiment, the flexible valve 63 is largely impervious to damage, the first and second panels thereof may be formed from thinner polyolefin films, ranging in thickness, e.g., from about 0.25 to about 5 mils, such as from about 0.5 to about 4 mils, about 0.75 to about 3 mils, about 1 to about 2 mils, etc. In some embodiments, the use of a thinner material for the flexible valve 63 may produce a more effective seal with less air leakage than is typically possible with thicker materials.

Again referring to FIG. 2, additional components that may be incorporated into the inflatable containers 12 include a first reinforcement patch 80, second reinforcement patch 78, leading eyelet tabs 74*a* and 74*b*, and connector 82. In some embodiments, these components may be the focal points of any stresses produced during the inflation of the containers. As such, these components may generally be made of a material of comparable thickness to that used for the flexible housing 18. If desired, the durability of some of these components can also be increased with additional layers of reinforcing material. For example, the durability of leading eyelet tabs 74*a* and 74*b* could be improved by gluing, heat sealing, or otherwise adhering additional material around the periphery of leading eyelets 76*a* and 76*b*. A similar reinforcement could be made on the trailing eyelets 72*a* and 72*b*.

Of course, the choice of materials for each component is ultimately dependent on the demands of the packaging task being addressed with the packing cushions. For instance, if reuse of the cushions is not a concern, then reinforcing the leading and trailing eyelets may be unnecessary. In addition, a manufacturer of the packing cushions of the present invention may wish to cut each component from the same stock material. For instance, a manufacturer may wish to use 3 mil polyethylene for every cushion component. Such modifications will likely have minimal impact on the functionality of the cushions; therefore, the choice of material is made by considering both manufacturing costs and cushion performance.

In some embodiments, each component of inflatable containers 12 may be cut from sheets of stock material by employing a severing device such as a rotating die cutter, as is well known in the art. For example, a cutter can easily be designed to concurrently cut a valve orifice 68 and first valve panel 66. Similarly, trailing eyelets 72*a* and 72*b* and leading eyelets 76*a* and 76*b* can be cut concurrently with second housing panel 62 and leading eyelet tabs 74*a* and 74*b*, respectively. Perforation 86 made in connector 82 can also be made immediately following or preceding the cutting stage in the manufacturing process. It should be understood that while die cutters are often used in the art, many other methods of cutting a flat material such as linear polyethylene into a variety of shapes can be utilized with little or no impact on the resulting packing cushion.

With reference to FIG. 2, four areas of ink, namely outer heat resistant coatings 88*a* and 88*b* and inner heat resistant coatings 90*a* and 90*b*, may be printed on the side of first valve panel 66 that is facing second valve panel 64. The purpose of such ink coatings is to prevent any undesired joining of components caused by the transmission of heat through more than two layers of material during the heat sealing processes. In this particular embodiment of the packing cushion, the ink coatings prevent the accidental permanent closure of the passageway defined by the flexible valve 63; they also ensure that valve openings 70*a* and 70*b* (see FIG. 1) remain open. This technique of preventing two pieces of heat-sealable material from being accidentally joined together is well known to persons skilled in the art.

Figure 4A:
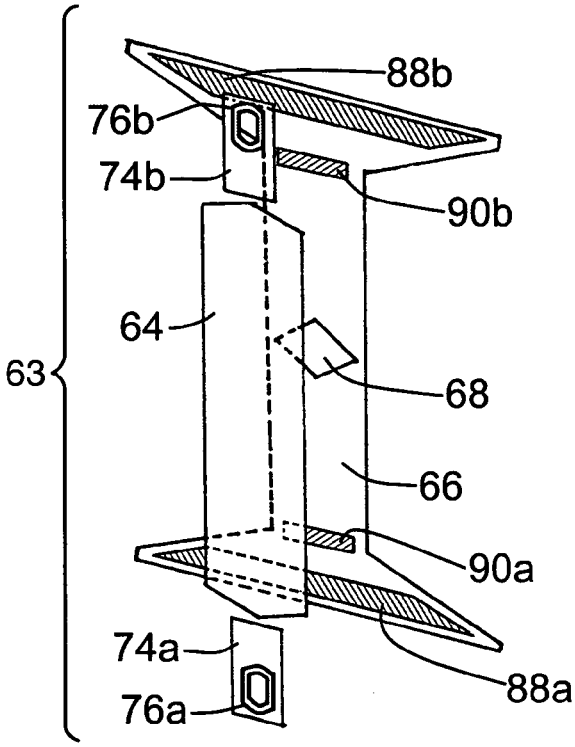

FIGS. 4A-9B collectively illustrate an order and manner in which components of the inflatable container may be assembled and joined together to form a completed un-inflated packing cushion in accordance with the present invention. FIGS. 4A and 4B together teach a first assembly step; FIGS. 5A and 5B teach an assembly step which can be performed separately and concurrently with the first step; FIGS. 6A and 6B similarly teach an assembly step that can be performed separately and concurrently with the first step; FIGS. 7A and 7B teach a second assembly step, which may follow the assembly depicted in FIGS. 5A and 5B, as it builds on that assembly; FIGS. 8A and 8B teach another "second" assembly step which may be performed after the assemblies taught in FIGS. 4A, 4B, 6A, and 6B are completed, but which can be performed separately and in parallel with the assembly taught in FIGS. 7A and 7B; and FIGS. 9A and 9B teach a third and final assembly step used to build an individual packing cushion. A more detailed description of each assembly step is given in the following paragraphs.

Figure 4B:
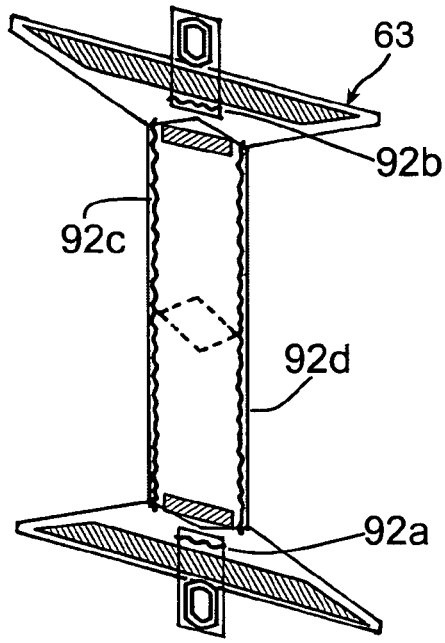
FIG. 4B is a collapsed perspective view of the components illustrated in FIG. 4A, illustrating the location of heat seal joints between the components.

FIG. 4A is an exploded perspective view of flexible valve 63, showing an arrangement of second valve panel 64 and first valve panel 66 relative to one another. Additionally, FIG. 4A shows the relative arrangements of leading eyelet tabs 74*a* and 74*b* with the other pictured parts. Related FIG. 4B illustrates an assembled perspective view of the parts of FIG. 4A, which have been welded together. In addition, FIG. 4B indicates a location for heat seal joints 92*a* and 92*b* between each leading eyelet tab 74*a* and 74*b* and first valve panel 66; also indicated are heat seal joints 92*c* and 92*d* between second valve panel 64 and first valve panel 66. The heat sealed joints may be made through the application of heat to a sealable material, such as polyethylene, in a manner well known to those skilled in the art. Leading eyelet tabs 74*a* and 74*b* are positioned so as to avoid any intersection between leading eyelets 76*a* and 76*b* and first valve panel 66. Additionally, heat seal joints 92*a* and 92*b* are preferably made so as to leave several centimeters of the overlap area between each leading eyelet tab 74*a* and 74*b* and first valve panel 66 unsealed. In other words, the heat sealed joints between leading eyelet tabs 74*a* and 74*b* and first valve panel 66 preferably do not extend all of the way to the edge of the first valve panel 66; rather, joints 92*a* and 92*b* may stop short of the edge by several centimeters as this may facilitate inflation.

Also apparent from FIG. 4B is that second valve panel 64 may be centered on first valve panel 66. The figure also shows that heat sealed joints 92*c* and 92*d* may be made along the entirety of the longest edges of second valve panel 64; furthermore, inner heat resistant coatings 90*a* and 90*b* may lie fully between heat sealed joints 92*c* and 92*d* without any intersection of the joints and coatings.

Figure 5A:
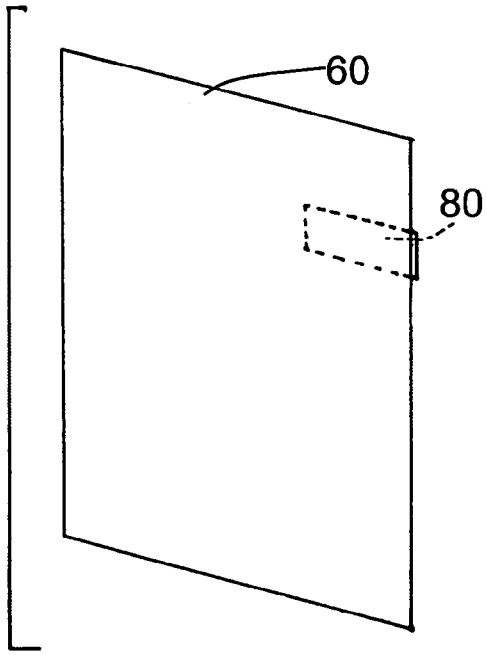
FIG. 5A is an exploded perspective view of a first housing panel and a first reinforcement patch of the inflatable container.
Figure 5B:
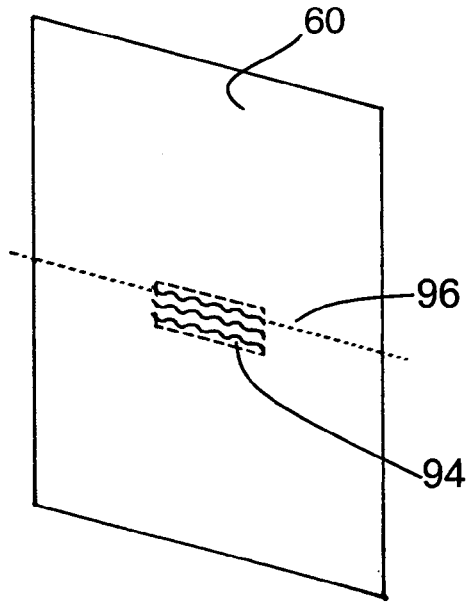
FIG. 5B is a collapsed perspective view of the components illustrated in FIG. 5A, illustrating the location of heat seal joints between the components.

FIG. 5A and 5B together illustrate a placement of first housing panel 60 and first reinforcement patch 80 relative to one another. The location of a heat sealed joint 94, which may be used to bond patch 80 to panel 60, is shown in FIG. 5B. A centerline 96 is also drawn perpendicular to the longer sides of first housing panel 60 and equidistant from the two shorter sides of the same component. The inclusion of centerline 96 is to illustrate that first reinforcement patch 80 may be affixed to first housing panel 60 slightly off-center. The reasoning behind the shifted placement of first reinforcement patch 80 will become more apparent through the description of FIG. 7B, and so will be discussed in short order.

Figure 6A:
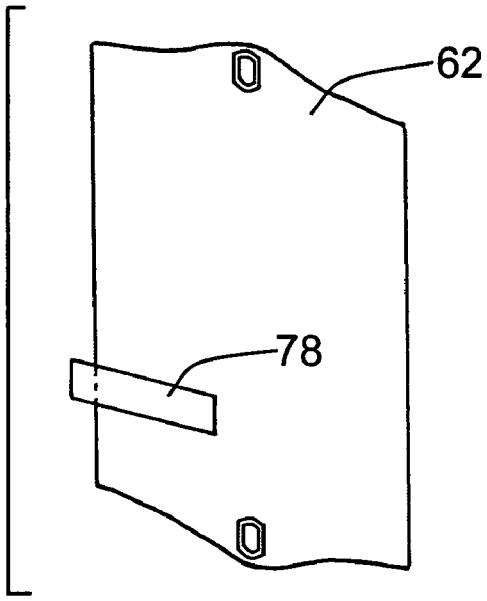
FIG. 6A is an exploded perspective view of a second housing panel and a second reinforcement patch of the inflatable container.
Figure 6B:
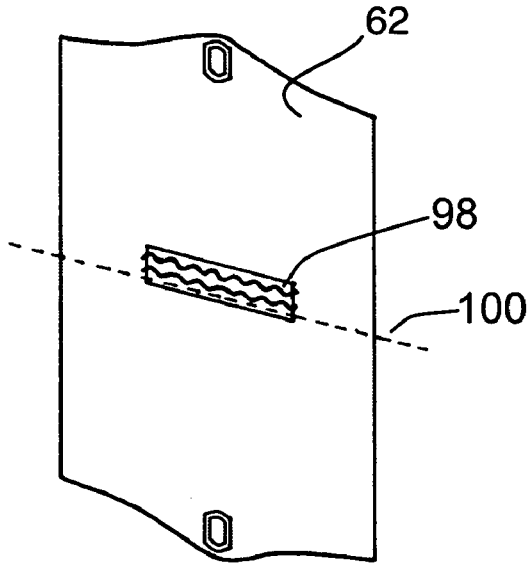
FIG. 6B is a collapsed perspective view of the components illustrated in FIG. 6A, illustrating the location of heat seal joints between the components.

FIG. 6A and 6B together illustrate the placement of second housing panel 62 and second reinforcement patch 78 relative to one another, wherein patch 78 is attached to housing panel 62 via heat seal joint 98 or other bonding means. The location of a heat sealed joint 98 is also pictured in FIG. 6B. A centerline 100 is also drawn perpendicular to the longer sides of second housing panel 62 and equidistant from the two furthest separated points of the same component. The inclusion of centerline 100 should help illustrate that second reinforcement patch 78 may be affixed to second housing panel 62 slightly off-center, but shifted in the opposite direction from that of first reinforcement patch 80 in FIG. 5B, as previously described. Again, the reasoning behind such placement choices will become apparent through the description of another figure, namely FIGS. 10A and 10B.

Figure 7A:
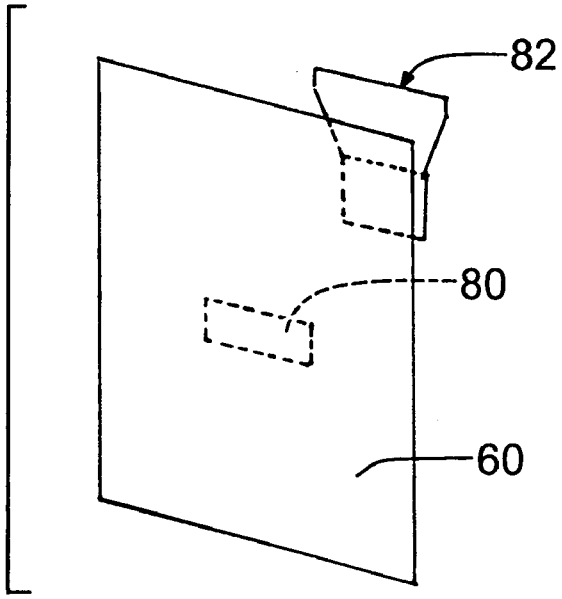
FIG. 7A is an exploded perspective view of the first housing panel with affixed reinforcement patch and a connector of the inflatable container.
Figure 7B:
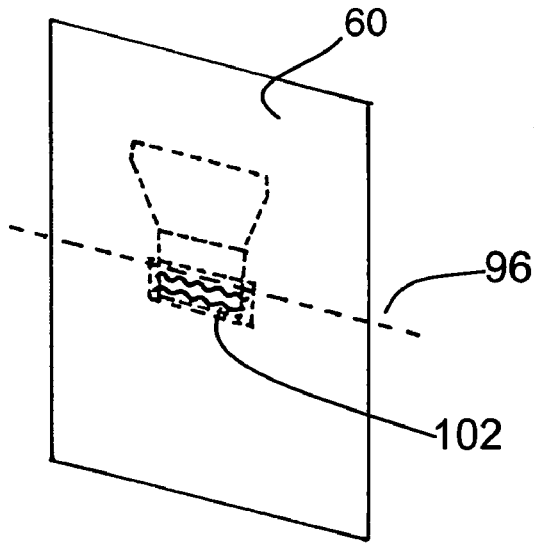
FIG. 7B is a collapsed perspective view of the components illustrated in FIG. 7A, illustrating the location of heat seal joints between the components.

FIG. 7A and 7B together illustrate a relative placement of a joined first housing panel 60, first reinforcement patch 80, and connector 82. First reinforcement patch 80, which at this stage of assembly is already attached to first housing panel 60, is located between connector 82 and first housing panel 60. It can then be discerned from the illustration in FIG. 7B that connector 82 may be affixed to first reinforcement patch 80 by a heat sealed joint 102, e.g., by applying heat from connector 82 through to first reinforcement patch 80. In some embodiments, connector 82 may exert tension on neighboring packing cushions at centerline 96 of each cushion. That being the case, heat sealed joint 102 described in FIG. 7B may conveniently remain on one side of, but flush with, centerline 96 (see, e.g., FIG. 10).

Figure 8A:
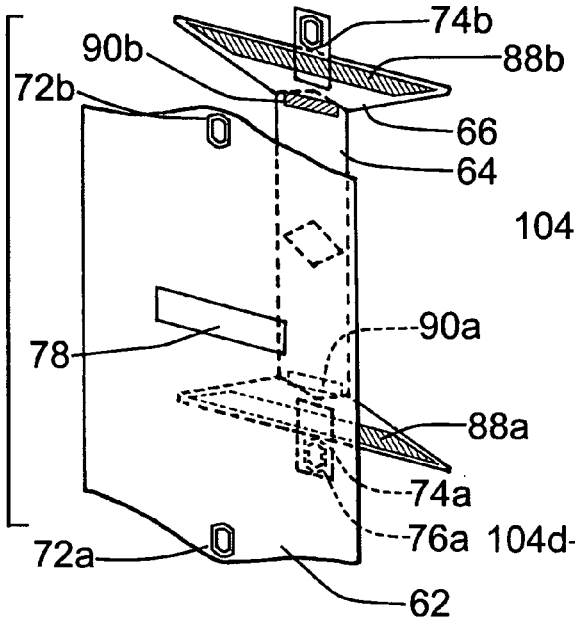
FIG. 8A is an exploded perspective view of the flexible valve, illustrated in FIG. 4B, and the second housing panel with affixed reinforcement patch of the inflatable container.
Figure 8B:
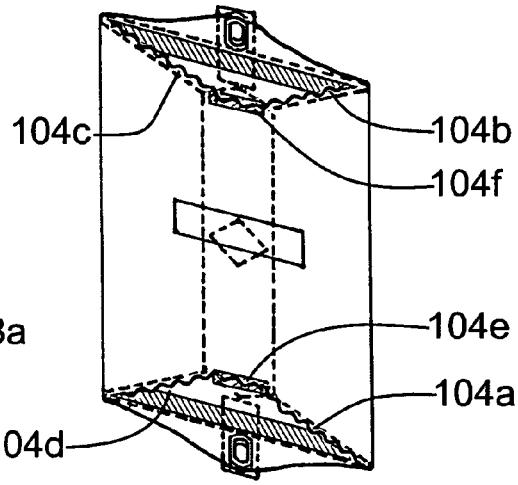
FIG. 8B is a collapsed perspective view of the components illustrated in FIG. 8A, illustrating the location of heat seal joints between the components.

FIG. 8A and 8B together illustrate the relative placement of a joined flexible valve 63 and leading eyelet tabs 74*a* and 74*b*, described in FIGS. 4A and 4B, and a joined second housing panel 62 and second reinforcement patch 78, as described in FIGS. 6A and 6B. An exemplary description of the relative placement of each pictured component may be as follows: second reinforcement patch 78 is followed by second housing panel 62, followed by second valve panel 64 and leading eyelet tabs 74*a* and 74*b*, collectively, finally followed by first valve panel 66. The relative arrangement of components can also be understood by referencing FIG. 2. FIG. 8B shows the location of heat sealed joints between several of the pictured components. In particular, heat sealed joints 104*a*, 104*b*, 104*c*, and 104*d* join second housing panel 62 with first valve panel 66; and heat sealed joints 104*e* and 104*f* join second housing panel 62 with second valve panel 64. Heat sealed joints 104*b* and 104*c* intersect with the end points of heat sealed joint 104*f*, and similarly heat sealed joints 104*a* and 104*d* intersect with the end points of heat sealed joint 104*e*. With the relative arrangement of the pictured components in mind, FIG. 8B shows that inner heat resistant coatings 90*a* and 90*b* prevent the transmission of heat from the creation of heat sealed joints 104*e* and 104*f* from reaching first valve panel 66. In other words, because inner heat resistant coatings 90*a* and 90*b* lie between second valve panel 64 and first valve panel 66, the heat used to create heat sealed joints 104*e* and 104*f* will only succeed in joining second housing panel 62 with second valve panel 64. Hence, second valve panel 64 will not be joined to first valve panel 66 along the line of heat sealed joints 104*e* and 104*f*. In some embodiments, prevention of such an undesired heat sealed joint may be necessary for a functional flexible valve 63.

The angles between the heat sealed joints 104*a-f* pictured in FIG. 8B may not only create large valve openings 70*a* and 70*b* in the packing cushion (see FIG. 27), but may also create a gusseted structure which allows for enhanced cushion expandability. In other words, the valve openings may serve an additional role by providing the gusseted structure of the cushion. This increased expandability may translate into increased inflation capacity.

Figure 9A:
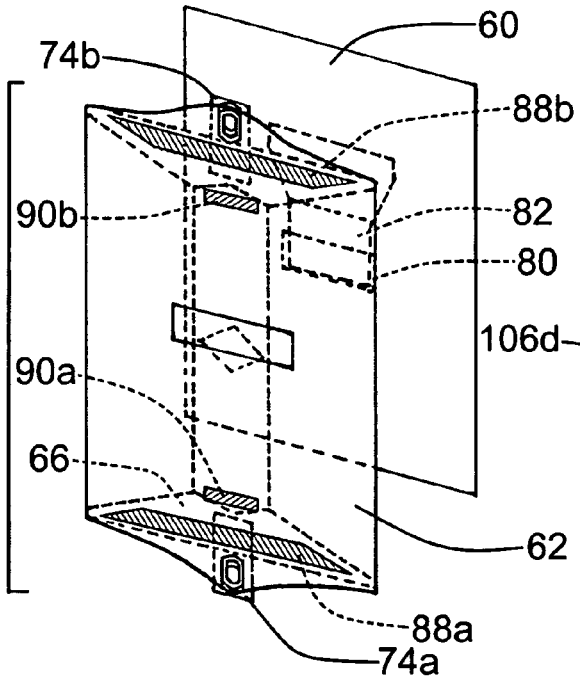
FIG. 9A is an exploded perspective view of the sub-assemblies illustrated in FIGS. 7B and 8B.
Figure 9B:
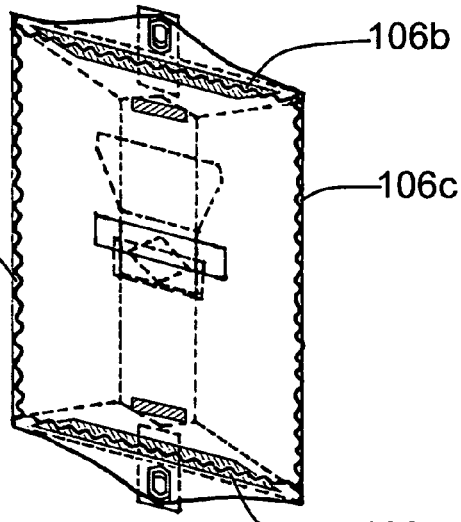

FIG. 9A and 9B together illustrate a relative placement of the sub-assembly described in FIGS. 8A and 8B and the sub-assembly described in FIGS. 7A and 7B. The relative arrangement of each component may as follows: the sub-assembly taught in FIGS. 8A and 8B is followed by first housing panel 60, followed by first reinforcement patch 80, followed by connector 82. FIG. 9B shows the location of heat sealed joints between several of the pictured components. In particular, heat sealed joints 106*a* and 106*b* may join first housing panel 60 with first valve panel 66, e.g., via a sealing apparatus that applies heat from first housing panel 60 through to first valve panel 66. Because outer heat resistant coatings 88*a* and 88*b* lie between first valve panel 66 and both leading eyelet tabs 74*a* and 74*b* and second housing panel 62, the heat sealing operation which creates heat sealed joints 106*a* and 106*b* will not cause undesired unions. In particular, outer heat resistant coatings 88*a* and 88*b* prevent the undesired joining of first valve panel 66 and leading eyelet tabs 74*a* and 74*b* along the lines of heat sealed joints 106*a* and 106*b*. Heat resistant coatings 88*a* and 88*b* also prevent the undesired joining of first valve panel 66 and second housing panel 62 along the lines of heat sealed joints 106*a* and 106*b*. FIG. 9B also shows heat sealed joints 106*c* and 106*d*; these join first housing panel 60 and second housing panel 62. These heat sealed joints 106*c* and 106*d* preferably each intersect heat sealed joints 106*a* and 106*b*.

An outline of an assembly procedure for the inflatable containers 12 can be summarized as follows: First, the sub-assembly resulting in the flexible valve 63 is formed, and leading eyelet tabs are attached to this flexible valve 63. A parallel, separate process may serve to reinforce certain areas of the container's top and first housing panel. A connector may then be affixed to the reinforced first housing panel. Finally, the first and second housing panels 60, 62 envelop and attach to the flexible valve 63 via a particular heat sealing pattern. This summary is clearly rather general, and certain key points made in the previous detailed assembly procedure are not included. The purpose of this generalization is to draw attention to the fact that the details of the described embodiment are merely meant to be illustrative rather than binding. For instance, when first housing panel 60 and second housing panel 62 are sealed together on four sides, they form the flexible housing 18. Alternatively, the flexible housing could be made of a sheet folded along a centerline and then heat sealed or glued along the three open sides. Flattened tube stock of an appropriate material could also be used to form the flexible housing of the inflatable container, wherein first the flexible valve 63 could be inserted into one of the open ends of the tube; and second, the open ends of the tube could be sealed shut. Other possible alterations abound, such as using lines of glue to join components rather than using heat sealing techniques. A number of other adhering methods of course could also be substituted. It should then be understood that while specific terms have been applied in the preferred embodiment, they are used in a generic and descriptive sense only and not for purposes of limitation.

Figure 10A:
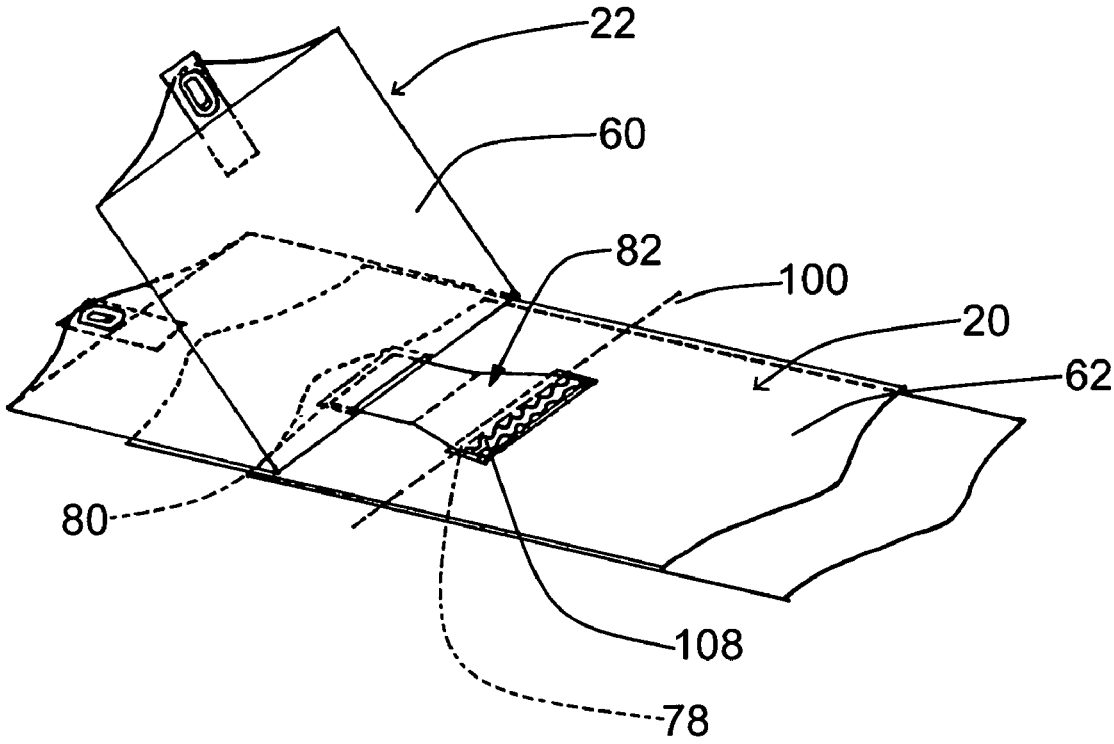
FIG. 10A is a perspective view of several un-inflated inflatable containers of the present invention, illustrating a method by which completely assembled individual inflatable containers may be connected to one another.
Figure 10B:
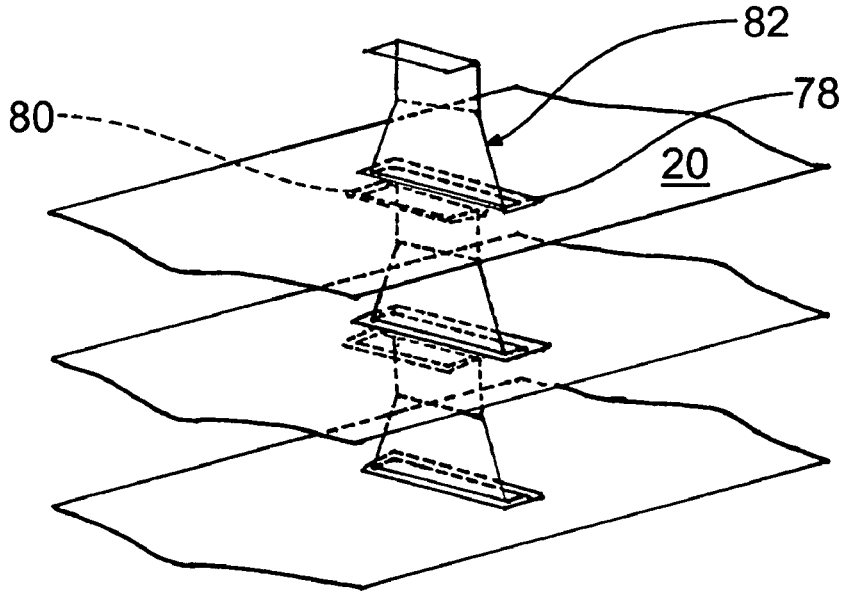
FIG. 10B is a perspective view of several un-inflated inflatable containers connected to one another by a plurality of the connectors.

After the assembly of individual packing cushions is complete, a series of these assembled individual packing cushions can be connected to one another through a procedure illustrated in FIG. 10A. Each assembled cushion may have a connector 82 attached to its first reinforcement patch 80, which itself is attached to a first housing panel 60. An assembled un-inflated packing cushion 20 may be placed flat on a suitable workspace, conveyor, or the like, with its second housing panel 62 facing upwards. Another assembled un-inflated packing cushion 22, folded completely or partially along its centerline 96 with its connector 82 facing second housing panel 62 of un-inflated packing cushion 20, may then placed onto packing cushion 20. Connector 82 of folded un-inflated packing cushion 22 is then aligned with second reinforcement patch 78 of flat un-inflated packing cushion 20. If desired, the alignment may allow for a small margin of second reinforcement patch 78 to remain unobstructed by overlapping connector 82, as pictured. Connector 82 may then be joined to second reinforcement patch 78 by heat sealed joint 108. Heat sealed joint 108 may extend to centerline 100, as pictured. Un-inflated packing cushion 22 can then be un-folded and placed flat atop un-inflated packing cushion 20; the process can then be repeated with another packing cushion. In this way, any number of packing cushions can be connected to one another along their respective center axes. FIG. 10B illustrates three cushions connected by connectors 82. Both FIGS. 10A and 10B have been simplified in order to highlight those components integral in the connection of a plurality of cushions to one another.

After the connecting procedure, the connected packing cushions can be arranged into a stack, whereby the connector 82 between each cushion is folded so as to allow for aligned stacking. When employed, second reinforcement patch 78 may serve two purposes: one, to reduce the possibility of rupture at centerline 100 by distributing the force exerted on second housing panel 62 by connector 82 as cushions are pulled along guide track 28 (pictured in FIG. 1), and two, to prevent the inadvertent joining of other components during the formation of heat sealed joint 108. In regards to the second purpose, second reinforcement patch 78 may serve to block the transmission of heat from the sealing operation responsible for joint 108 from reaching other cushion components. This purpose is similar to that of heat resistant ink coatings 88*a*, 88*b*, 90*a*, and 90*b* during earlier stages of assembly. Indeed, if first housing panel 60 and second housing panel 62 are made of sufficiently thick and strong material, neither reinforcement patch 78 or 80 are necessary to prevent rupture of the flexible housing 18 of the cushion. If the reinforcement patches are not utilized in such a situation, however, an additional patch of heat resistant ink may advantageously be printed on the internally facing side of second housing panel 62 in order to prevent any unintended joining of components during the cushion connection procedure described in FIG. 10A. Of course, other joining methods could be used to attach connector 82 to the surface of second housing panel 62. For instance, connector 82 could be glued with adhesive to second housing panel 62; and since heat would not be necessary in such a joining procedure, the need for a heat blocking mechanism would be eliminated.

While an inflatable container, e.g., a packing cushion, of a particular construction has been described, it is to be understood that the present invention is not limited to containers of such a specific design. As mentioned, the described embodiment of the present invention touts heat sealing as the overall preferred method of joining components, partially because it offers simplicity of manufacture and establishment within the art; however, as has been described, other joining methods, such as the application of an adhesive, are also valid substitutes. Other obvious modifications, such as the size or shape of valve orifice 68, or the particular shape of first valve panel 66 or second housing panel 62, can be made without altering the basic functionality of the present invention. As another example, the flexible housing 18 of the packing cushion need not necessarily be rectangular in shape for an operable inflatable packing cushion. Therefore, the specific nature of the present description should not be viewed as limiting of the basic invention being claimed.

Figure 11A:
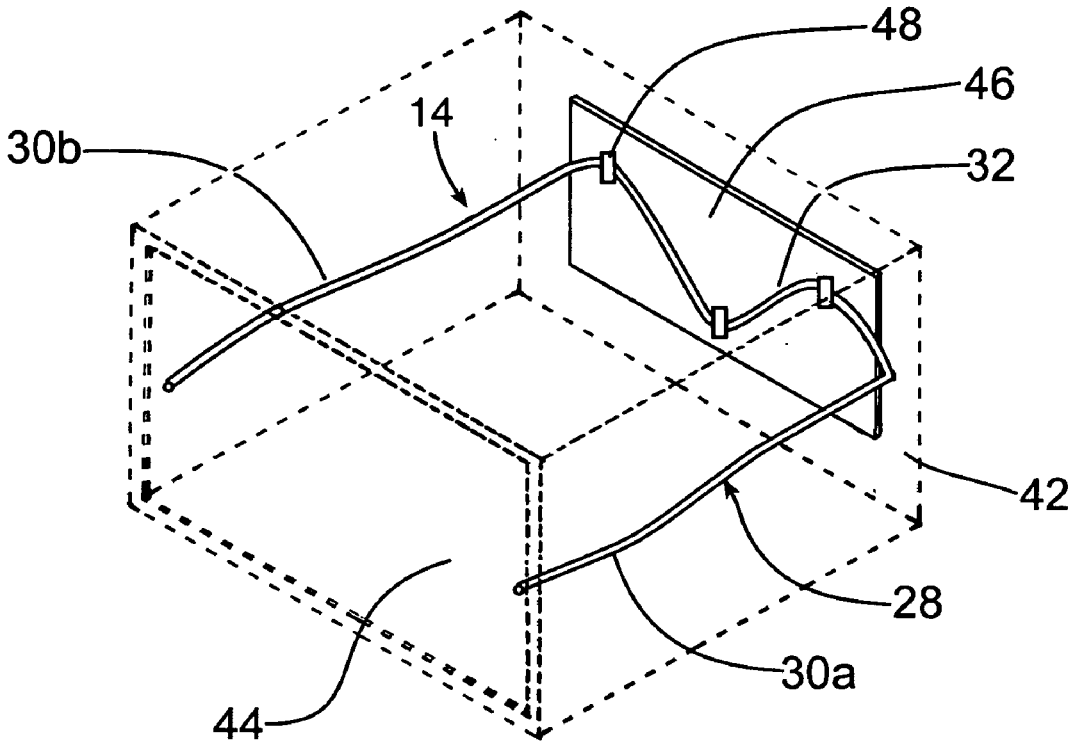
FIG. 11A is a perspective view of a preferred embodiment of the guide track, illustrating one way in which the guide track may be affixed to the interior of a box.

Referring now to FIGS. 11-12, a suitable embodiment for support structure 14 will be described, which may include a guide track 28 as shown. Guide track 28 may be used to hold and inflate the inflatable containers 12 described above to form an inflatable container system 10, as shown in FIG. 1. In such system, containers 12 may be movably and/or removably mounted on support structure 14. In this embodiment, guide track 28 may be affixed within a box 42 or other container (see FIG. 11A; box 42 shown in phantom for clarity). As shown, guide track 28 may be attached to a box reinforcement 46, which itself is affixed to the interior of box 42. Suitable fasteners, such as wire ties, staples, or plastic clamps, can be used to attach guide track 28 to box reinforcement 46 within box 42. An arrangement of these fasteners is shown in FIG. 11A, in which the guide track fasteners are indicated by the numeral 48. As illustrated, guide track 28 may include guide track arms 30*a* and 30*b* and a guide track back 32.

Figure 11B:
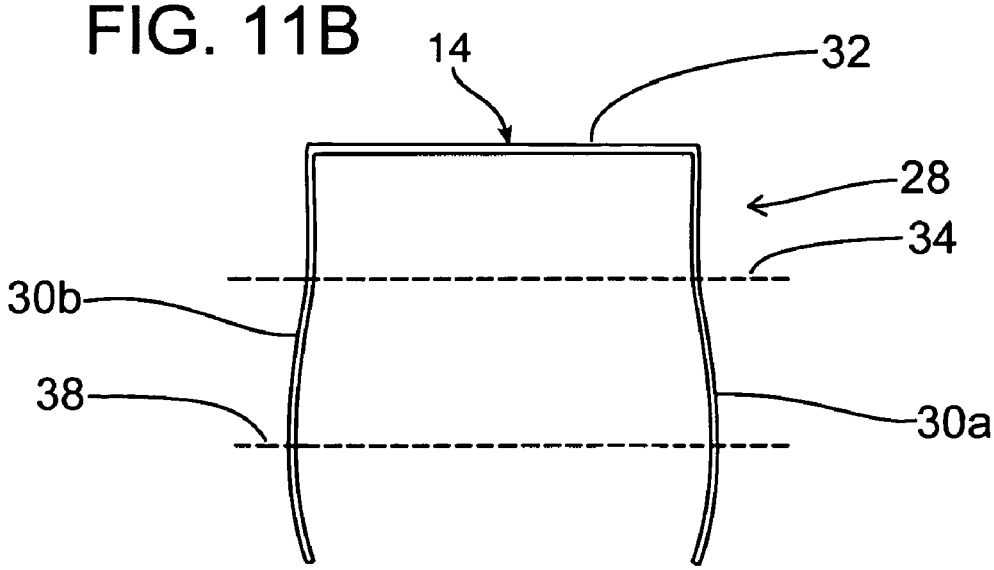
FIG. 11B is a top view of the guide track depicted in FIG. 11A.

In some embodiments, support structure 14 may be shaped such that movement of a container 12 thereon, e.g., removal of a container therefrom, provides exertion of the "second force" on flexible valve 63 to change the shape thereof. As shown in FIG. 11B, for example, the shape of arms 30*a* and 30*b* of guide track 28 may be such that the separation distance between arms 30*a* and 30*b* varies. In the illustrated example, at the intersection of arms 30*a* and 30*b* with guide track back 32, the distance between arms 30*a* and 30*b* may be at a minimum; between a reference line 34 and a reference line 38, the distance may gradually increase to a maximum; and between reference line 38 and the open ends of arms 30*a* and 30*b*, the separation distance may decrease to roughly the minimum. Thus, as the containers approach reference line 38, the arms of the guide track 28 diverge to thereby exert a tensioning or "second force" on valve 63. Then, between reference line 38 and the open ends of arms 30*a* and 30*b*, the arms converge as the containers move further along the track, thereby reducing exertion of the second force on the valve.

The distance between arms 30*a* and 30*b* and the manner in which it changes may determine the extent to which and the ease with which packing cushions are inflated, as explained below. The shape of guide track back 32, however, is of no particular functional importance and does not directly influence the quality of cushion inflation.

Guide track 28 can be made of a wide variety of materials, as the property tolerances demanded of guide track 28 are rather broad. In some embodiments, guide track 28 is desirably not made of materials that are excessively flexible. In general, various plastics (e.g., styrenes such as ABS, polyolefins, polyesters, polyamides, etc.), metals (e.g., hardened steel), or a variety of other materials will confer suitable rigidity. In this preferred embodiment, guide track 28 is constructed by bending a rod of suitable material such as steel into the described shape. Of course, other methods of formation, such as injection molding for one example, may also be employed. Additionally, although the guide track 28 of the present embodiment is made from a cylindrical "rod", rectangular prism "rods" or any other extruded polygonal shape can be used as well. In order to reduce material costs, guide track 28 could also be made using a shape with a particular extended cross-section, such as an extruded "cross" or "I" shape; a hollow pipe would also confer an increased "strength to material required" ratio.

Box 42 is not of particularly special construction in this embodiment, as its main purposes are to contain the cushions and guide track 28 while providing an attachment surface for guide track 28. As such, box 42 can be made of cardboard, plastic, or any other suitable material. Likewise, box reinforcement 46 can be made of any suitable material, such as cardboard or plastic, and can be affixed to the back inner face of box 42 using any number of surface adhesives or fasteners. The primary purposes of box reinforcement 46 is to ensure that guide track fasteners 48 do not tear through the back face of box 42 and to ensure a sturdy attachment of guide track 28 within box 42.

If desired, opening 44 in box 42 may be covered, such as with a peel-away cover or perforated box face. When the user chooses to initiate inflation of the packing cushions, the cover or perforated face can then be pulled away, thus revealing opening 44.

One possible method of assembling guide track 28, box reinforcement 46, and box 42 together is to assemble all components while box 42 is in its "unfolded", flattened state. Box reinforcement 46 can then be attached to the appropriate face of box 42, after which guide track 28 can be fastened to the joined box reinforcement 46 and box 42. Box 42 can then be folded into its final rectangular prism shape, with appropriate edges of box 42 being joined.

FIG. 1 illustrates that box opening 44 may be of such dimensions that it will accommodate the passage of an inflating or inflated packing cushion. FIG. 1 also illustrates a manner in which guide track arms 30*a* and 30*b* are fed through leading eyelets 76*a* and 76*b* and trailing eyelets 72*a* and 72*b* of the inflatable containers 12. While this step can be accomplished in a variety of ways, one possibility is to feed a stack of connected un-inflated packing cushions 24 onto guide track arms 30*a* and 30*b* after guide track 28 has been attached to the appropriate inner face of box 42, as has been described. This step can be accomplished before the box 42 is folded into its final, e.g., rectangular prism, form. Another option is to feed the stack of packing cushions 24 onto arms 30*a* and 30*b* before guide track 28 is attached to the box 42; this option, in other words, involves loading guide track 28 with cushions before attaching the track 28 to the appropriate inner face of box 42.

Although inflatable containers 12 are illustrated with eyelets 72 and 76 as the means by which the containers are attached to the support structure, other attachment devices may be employed to provide movable attachment of the container to the arm of the support structure, e.g., hooks, loops, etc.

A further consideration in the assembly of guide track 28 and the stack of packing cushions 24 is the number of cushions that can be accommodated by the track. In most embodiments, the height of the stack of packing cushions 24 will desirably not exceed the distance between guide track back 32 and reference line 34, as pictured in FIG. 11B. The preferred maximum number of packing cushions that can be accommodated by guide track 28 is thus dependent on the number of cushions that can stack to a height roughly equal to the distance just described.

Concerning the width of the packing cushions relative to the dimensions of guide track 28, the distance between the two intersection points of guide track arms 30*a* and 30*b* and guide track back 32 may be roughly equal to the distance between the centers of each trailing eyelet 72*a* and 72*b*. In this manner, the stack of un-inflated packing cushions 24 may be supported on guide track 28 with minimal tension between the cushion eyelets and guide track arms 30*a* and 30*b*, in the region between guide track back 32 and reference line 34. The maximum separation distance between arms 30*a* and 30*b* is located at reference line 38 in FIG. 11B. This distance may depend, in part, on the material chosen for guide track 28, the cross-sectional geometry of the track, and the length of arms 30*a* and 30*b*. Because these factors together determine the structural properties, and more specifically the rigidity of the arms 30*a* and 30*b*, they will also govern the lateral forces, i.e., the "second force," applied to the flexible valve 63 as the container is pulled along arms 30*a* and 30*b*. In general, the maximum distance between arms 30*a* and 30*b* will typically increase with decreasing rigidity of arms 30*a* and 30*b*; else, the lateral forces applied to a packing cushion at reference line 38 may not be sufficient to open the flexible valve 63. The ratio between maximum and minimum separation distance between the arms (i.e., ratio of distance at reference line 38 to distance at reference line 34) should not, however, be too great, else the guide track may have noticeable recoil as cushions are pulled along its length and inflated. The possible combinations of overall guide track geometry and track rigidity can thus be seen to be numerous, although not without restriction.

In the presently illustrated embodiment, the inflatable containers 12 comprising the stack of packing cushions 24 have their first housing panel 60 facing opening 44, as pictured in FIG. 1. It should be understood, however, that this is simply one possible configuration; many others are possible. Moreover, as was the case with the detailed description of the packing cushion, while specific terms have been used in the description of the support structure 14, such details should not be taken as limitations to the present invention.

In some embodiments, a plurality of inflatable containers 12 may be inflated in series. With reference to FIG. 1, a user 45 first gains access to the inflatable containers, e.g., packing cushions, 12. To do this, the user removes any covering or perforated cardboard face blocking opening 44. Second, the user reaches into box opening 44 and grasps detached connector 84, which itself is connected to the leading packing cushion. The user then proceeds to pull on detached connector 84 in the direction indicated in FIG. 1, thereby moving the leading packing cushion along guide track arms 30*a* and 30*b*. Very soon after this action is initiated, the leading cushion reaches reference line 34 indicated in FIG. 11B. As the leading, translating cushion crosses reference line 34, the diverging arms of guide track 28 will begin to exert lateral, outward tension on the cushion. At this point, the user pulls the cushion with slightly greater force to overcome the accompanying retarding forces caused by the increasing tension between guide track 28 and the cushion. Before crossing the plane of maximum separation of arms 30*a* and 30*b*, indicated by reference line 38 in FIG. 11B, the flexible valve 63 opens and the cushion begins to inflate. Leading eyelets 76*a* and 76*b* also begin to separate from the trailing eyelets 72*a* and 72*b*, respectively. Additionally, once the flexible valve 63 has opened and inflation has commenced, first housing panel 60 pulls away from second housing panel 62.

Soon after the leading cushion begins to inflate, connector 82 between leading, inflating packing cushion 26 and un-inflated packing cushion 20 fully extends; connector 82 extends until its midsection is perpendicular to the first and second housing panels of the connected cushions. Reference FIG. 1 for a snapshot of this particular operational stage. As the inflating packing cushion 26 continues to move along guide track arms 30*a* and 30*b* and out of box opening 44, the fully extended connector 82 begins to pull un-inflated packing cushion 20 along track arms 30*a* and 30*b*. When un-inflated packing cushion 20 reaches reference line 34, where arms 30*a* and 30*b* begin to diverge, it too begins to inflate as cushion 26 did immediately preceding it. The process of inflation will continue in the same manner for each successive cushion that is pulled along the length of guide track 28.

As the leading packing cushion 26 is pulled from box opening 44 and off of guide track 28, the user is presented with two choices. After cushion 26 has been pulled the entire length of guide track 28, it has evolved to its maximum inflation; the user may therefore choose to tear connector 82 joining leading cushion 26 and the successive cushion 20 along its perforation 86. The leading cushion 26 will consequently be separated from the remainder of partially-inflated and un-inflated packing cushions supported on guide track 28; this leading, inflated packing cushion can then be used in a variety of packaging capacities. The user can alternatively opt to continue to pull the fully inflated leading packing cushion 26, leaving connector 82 intact. Consequently, successive cushions will be pulled along guide track 28, and each inflated in turn. In this manner, a multiplicity of cushions may be inflated without interruption. When the desired number of cushions has been inflated, the user can then separate the inflated cushions from the un-inflated cushions remaining on guide track 28. In order to do so, the user must separate that connector joining the last of the series of inflated packing cushions from the leading cushion remaining on guide track 28 along its perforation.

In some embodiments, a desired degree of inflation is somewhere between about 60-80% of a cushion's full volume capacity, rather than 100% capacity. Partially inflated cushions are preferred in many end-use applications, largely because they are malleable and can mold to a variety of voids within a package; fully inflated cushions, however, are relatively rigid and are therefore less pliable. Additionally, a partially inflated packing cushion is less likely to rupture with varying ambient air pressure than a fully inflated cushion. This feature becomes important when, for instance, a package filled with inflated cushions is shipped via air transport. In other embodiments of the invention, however, a fuller degree of inflation may be desired, e.g., between about 70-100%.

An additional detail of the operation of the present invention concerns the mobile, or ungrounded, nature of box 42 and its contents. If, for instance, box 42 is resting on the flat, smooth surface of a desk, pulling cushions along guide track 28 will likely also pull box 42 and its contents towards the user. This forward sliding motion can be counteracted by placing a hand on box 42 and resisting the slight forward force of box 42. The user's free hand can then simply pull cushions along guide track 28, while box 42 is held in a stationary position. Single handed operation of the present invention can be achieved through slight modifications to this preferred embodiment. Most of these modifications effectively "ground" box 42 to a stationary object such as a table or shelf, or re-orient the guide track vertically. Such modifications are discussed below.

Figure 12A:
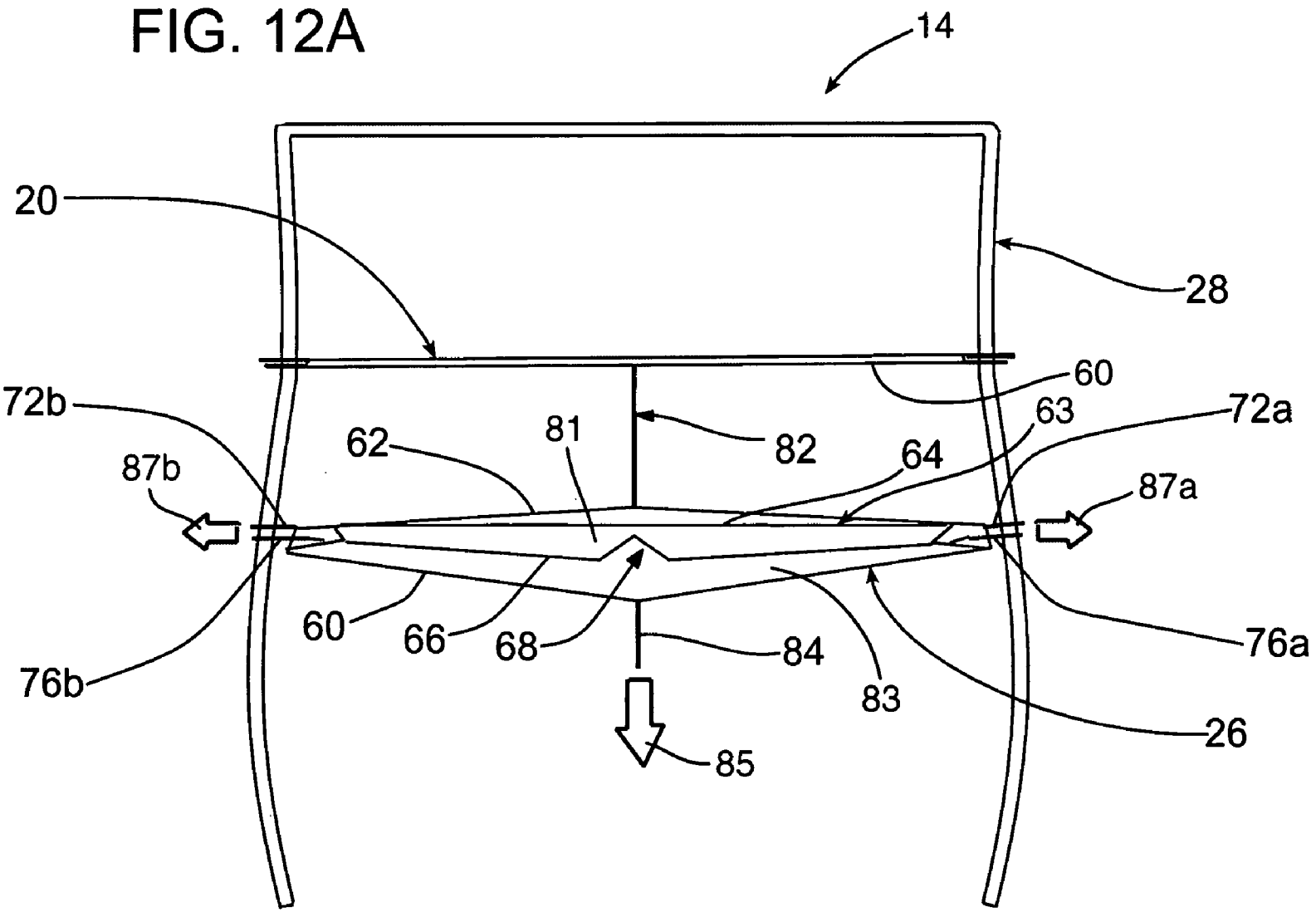
FIG. 12A is a simplified top view of two inflatable containers, one un-inflated and one undergoing inflation, and the guide track. The schematic further illustrates the way in which the valve of the present invention is opened by lateral forces as the inflatable container is pulled along the guide track.
Figure 12B:
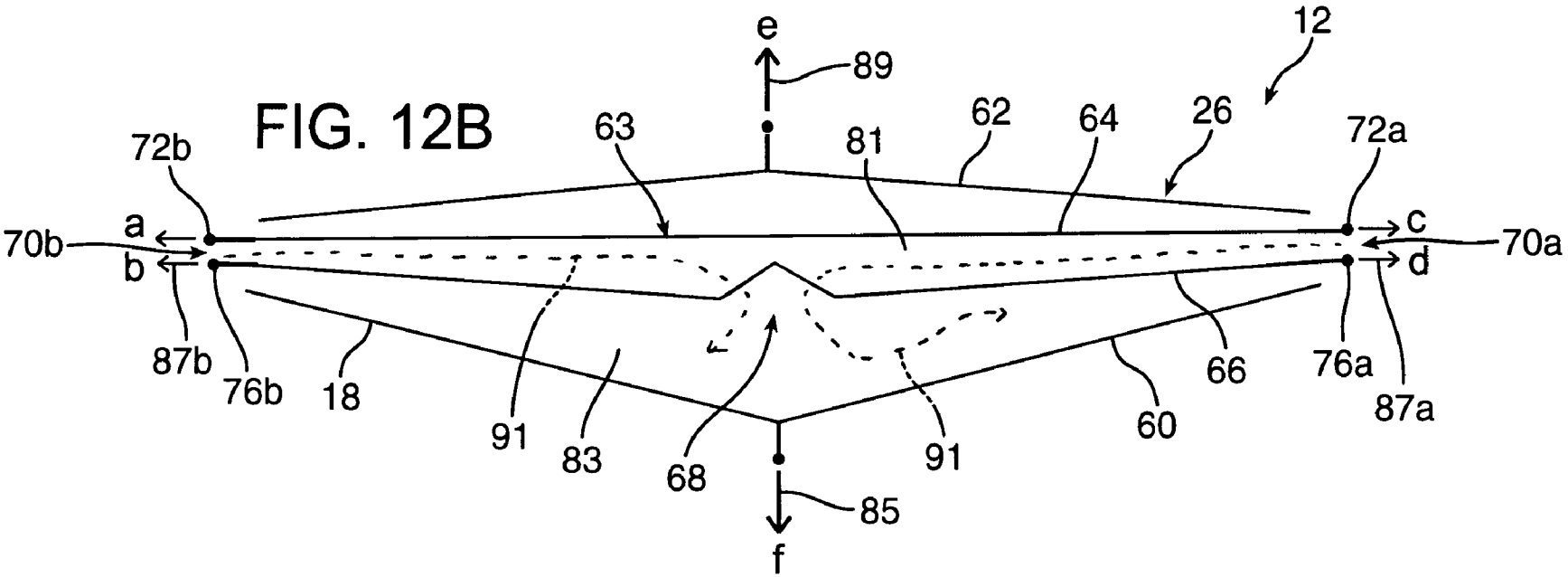
FIG. 12B is a further simplified schematic illustrating the way in which lateral forces conspire to open the valve of the inflatable container. Such lateral forces, together with additional external, outward forces, lead to the inflation of the inflatable container.

The mechanics governing the opening of the flexible valve 63 and the subsequent inflation of the corresponding inflatable container are diagrammed in FIG. 12A and 12B. FIG. 12A is a simplified top view of two cushions 20, 26, wherein cushion 20 is un-inflated and cushion 26 is undergoing inflation and being pulled along guide track 28. Inflation occurs when a first force is exerted on flexible housing 18 and a second force is exerted on flexible valve 63 such that the housing 18 and valve 63 each undergo a change in shape to draw fluid from the ambient environment, through valve 63, and into interior cavity 83 of the housing 18.

The forward-pointing arrow 85 in FIG. 12A represents a "first force" that may be exerted on housing 18, which may result when a packager or other user pulls an inflatable container 12, e.g., cushion 26, as shown. The two transverse arrows 87*a, b* represent a "second force" or, as shown, a pair of opposed second forces, which may be exerted on flexible valve 63. This may result when leading eyelet tabs 74*a* and 74*b*, and therefore valve 63 to which the tabs are attached, are stretched by forces resulting from pulling the container over the diverging arms of guide track 28, i.e., movement of container 12 on arms 36*a, b* provides exertion of the second force on flexible valve 63 to change the shape thereof. The resultant tensional force 87*a, b* may be exerted on one of the valve panels of valve 63, e.g., along the length thereof as in the present embodiment, which causes valve orifice 68 to change shape and open in a puckered or 'fish-mouth' fashion as shown. In addition, by exerting the second, tensional force 87*a, b* on valve 63, e.g., on first valve panel 66 thereof, the first valve panel with orifice 68 therein assumes a non-planar, three-dimensional shape, which creates a channel 81 between the first and second valve panels 66, 64 through which fluid, e.g., air, from the ambient environment can flow. Together, the channel 81 and open valve orifice 68 permit fluid communication between the interior cavity 83 of housing 18 and the ambient environment, i.e., the environment in which the container 12 is located.

As flexible valve 63 is opening, the first force 85 acting on first housing panel 60 and second housing panel 62 lead to their separation. As first housing panel 60 and second housing panel 62 separate, the internal volume of interior cavity 83 increases; this increase in volume results in a decrease in pressure relative to the pressure of the ambient environment in which the container is located, e.g., atmospheric pressure, and is the beginning of the container's inflation. That is, the reduced pressure within interior cavity 83, caused by the separation of housing panels 60, 62 and resultant volume increase of cavity 83, provides the driving force to draw in fluid from the ambient environment.

First force 85 thus produces a pressure differential between interior cavity 83 and the ambient environment. This pressure differential causes fluid in the ambient environment to exert a fluid force against flexible valve 63. But for the exertion of the second force 87 on flexible valve 63, the valve would not open to allow the force of the ambient fluid to push the fluid into cavity 83. As may thus be appreciated, second force 87 is independent of the ambient fluid force, and must be exerted on valve 63 to cause the change in shape of the valve that allows ambient fluid to be pushed into the cavity 83 via the pressure differential between the cavity and ambient environment, which results from the change in shape of the flexible housing 18 due to exertion of first force 85 on the housing. In this manner, flexible housing 18, flexible valve 63, first force 85, and second force 87*a* and/or *b* all cooperatively interact to draw fluid into the interior housing cavity 83 via the creation of relatively negative pressure within the housing cavity due to first force 85, and the simultaneous opening of valve 63 due to second force 87. In contrast to conventional inflatable containers/cushions, no inflate-and-seal machinery is needed to create positive pressure to force fluid into the housing. Instead, negative pressure is created within the housing 18 to draw fluid into the housing, i.e., to allow atmospheric pressure to push the fluid through the valve 63 and into the interior cavity 83.

For some embodiments, the separation of first and second housing panels 60, 62 may be enhanced by forming the inflated containers 12 with a gusseted design. More specifically, valve openings 70*a* and 70*b*, pictured in FIGS. 12B and 27, may be formed to serve the additional purpose of providing the container with a gusseted structure. Such a gusseted container has more freedom to expand than would otherwise be the case, and such freedom corresponds to a greater inflation potential. One such construction of a valve that has openings with a gusseted structure is shown in FIG. 8B (and described above).

A more particular look at the forces that conspire to both open the flexible valve 63 and promote inflation of the packing cushion is given in the schematic diagram of FIG. 12B, in connection with inflating container 26. The lateral, outward "second" forces 87*a, b*, which lead to the opening of the flexible valve 63, are labeled with direction arrows "b" and "d" in FIG. 12B to distinguish such forces from forces "a" and "c", which may also be exerted on flexible valve 63, as described below. As noted above, second forces 87*a, b* may be exerted upon first valve panel 66 to cause the temporary deformation of the first valve panel. First valve panel 66 consequently warps and pulls away from second valve panel 64, an action which constitutes the opening of the flexible valve 63 as channel 81 is created therein, i.e., between first and second valve panels 66, 64. As shown, channel 81 may extend between and communicate with the valve openings 70*a, b*, and may also be in fluid communication with valve orifice 68. Valve orifice 68 is also deformed, e.g., puckered, when subjected to the second forces 87*a, b*, in such a fashion that the orifice opens to allow fluid communication, via channel 81, between interior cavity 18 of flexible housing 18 and the ambient environment.

The forces labeled "a" and "c" may be exerted in directions that are generally parallel to directions "b" and "d" of second forces 87*a, b*, and may result from the interaction between eyelets 72*a, b* of second housing panel/second valve panel 62, 64 and guide track 28. As cushion 26 is pulled along the diverging arms of guide track 28, leading eyelets 76*a* and 76*b* tend to distance themselves from trailing eyelets 72*a* and 72*b*. This separation facilitates the complete opening of the flexible valve 63, particularly of valve openings 70*a* and 70*b*. The cause of this separation of eyelets, and consequently of attached components, is related to the cushion's resistance to movement along the diverging arms of guide track 28. Leading eyelets 76*a* and 76*b* experience a slightly different drag than is experienced by trailing eyelets 72*a* and 72*b*, due to their slightly different positions on the inflatable container. It is this slight difference in resistance to movement (drag) that causes the separation of the eyelets during movement of the container along the track 28. This difference in drag may be enhanced by constructing the container such that leading eyelets 76*a, b* have a different lateral spacing, relative to the flexible housing 18, than trailing eyelets 72*a, b*. For example, leading eyelets 76*a, b* may be slightly outboard of trailing eyelets 72*a, b*.

The leading eyelet tabs 74*a* and 74*b* may be joined to first valve panel 66 with heat sealed joints 92*a* and 92*b*, as depicted in FIG. 4B. Preferably, the entire overlap region between leading eyelet tabs 74*a* and 74*b* and first valve panel 66 is not fused together; instead, only a portion of the overlapped region is fused together as shown in FIG. 4B as this may allow for increased degrees of freedom in the expansion, and corresponding inflation, of the cushion.

After the flexible valve 63 opens, the cushion can begin to inflate, e.g., as the result of a kind of geometric manipulation of the cushion. In FIG. 12B, the first force 85 exerted on first housing panel 60 is labeled by arrow "f", which indicates the direction of this force. First force 85, e.g., as provided by the user as he/she pulls the cushion, motivates each cushion to move along guide track 28, and it is transmitted via a connector 82 or detached connector 84 to first housing panel 60 of the cushion. This manipulation of the first housing panel 60, and therefore of the entire flexible housing 18, by first force 85 leads to a lowering of the pressure within the inflatable container. When the ambient environment in which the container is located is air at sea level, the external air pressure will be approximately 1 atm, which is higher than the lowered air pressure within the container. Through the opened flexible valve 63 of the container, this pressure difference is necessarily equalized as air flows into the container through the flexible valve 63, as indicated by the dotted lines 91 in FIG. 12B, until pressure equilibrium is reached. The container is thereby inflated.

In the illustrated embodiment, first force 85 may thus be exerted in a first direction, i.e., direction "f," while second force or forces 87*a* and/or *b* may be exerted in a second direction or, as illustrated, in a pair of opposing second directions "b" and "d," wherein the first direction "f" is different from second direction(s) "b" and "d." For example, the first and second directions 85, 87 may be substantially perpendicular to one another as shown.

A force 89 that may optionally be exerted in the opposite direction is indicated by the label "e" to show the direction of this force, which may be in opposition to direction "f" of first force 85. Force 89 may result from weight or drag exerted by subsequent packing cushions being pulled along guide track 28 by connector 82. Connector 82 connects second housing panel 62 of the leading packing cushion with first housing panel 60 of a subsequent packing cushion, as depicted in FIG. 12A. Force 89 is optional, however, as inflatable containers in accordance with the present invention inflate to an equal, or at least nearly equal, degree with only the application of a first force 85 and no force 89.

Figure 27:
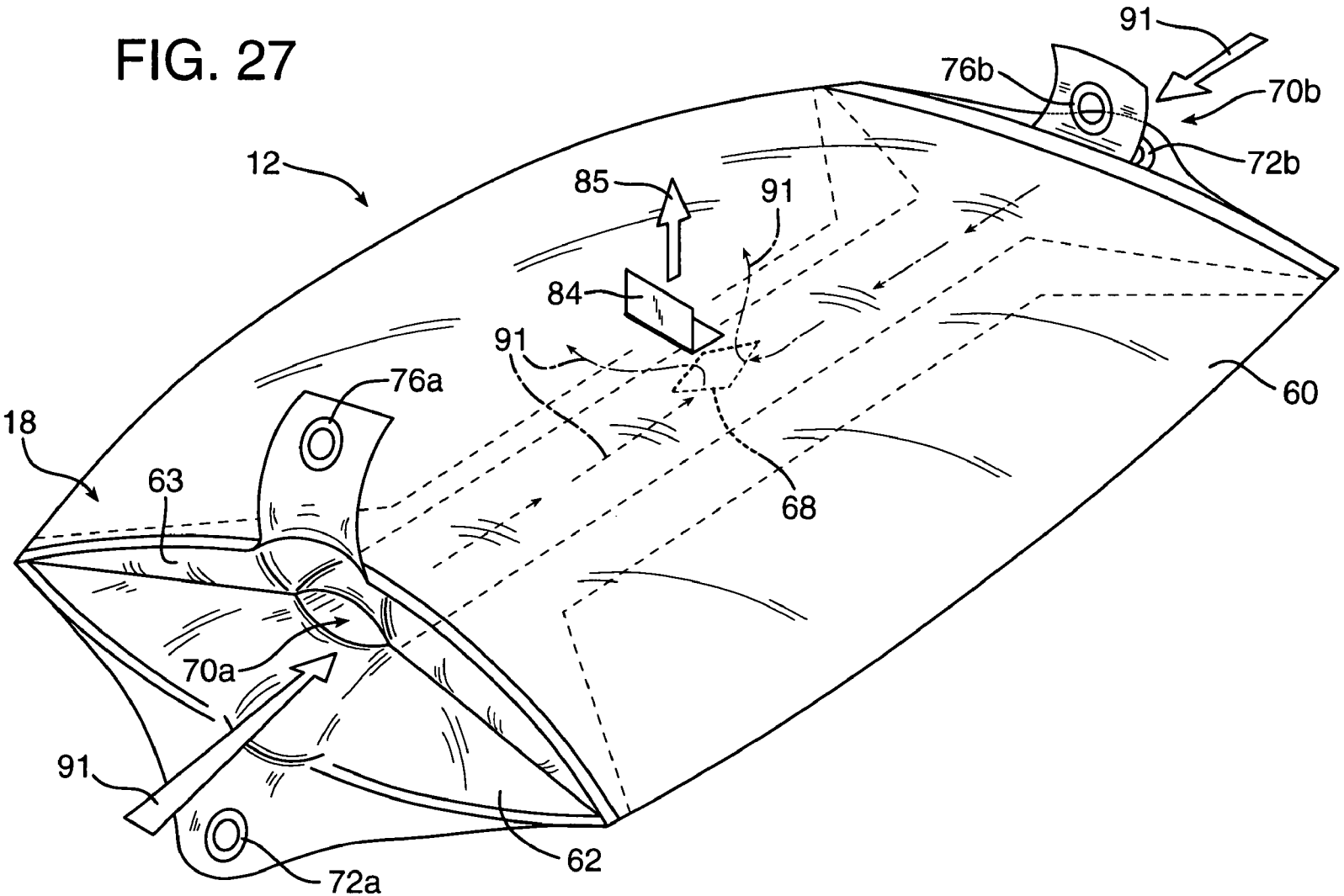
FIG. 27 is a side view of an inflatable container as shown in FIG. 1, wherein fluid from the ambient environment is entering the container via valve openings in the flexible valve.

FIG. 27 illustrates the inflation of container 12 from the perspective of valve opening 70*a* (a perspective of the opposing valve opening 70*b* would be identical). When first force 85 is exerted on flexible housing 18, e.g., manually via pull tab 84, the housing changes shape as shown. Simultaneously, when a second force is exerted on flexible valve 63, e.g., via support structure 14 (not shown for clarity), it changes shape as well and allows valve openings 70*a, b* to assume an open position as shown. As a result, fluid 91 from the ambient environment, e.g., air, is drawn into the valve openings 70*a, b* as shown, whereupon it flows through valve 63 and enters flexible housing 18 via valve orifice 68 to inflate such housing, as also shown.

Once the leading and trailing eyelets of the leading inflating cushion have crossed the plane of greatest separation between arms 30*a* and 30*b*, indicated by reference line 38 in FIG. 11B, the forces which led to the opening of the flexible valve 63 will begin to decrease. Trailing eyelets 72*a* and 72*b* and leading eyelets 76*a* and 76*b* will rapidly approach each another. With the lateral forces acting on the flexible valve 63 diminishing, second valve panel 64 and first valve panel 66 will tend to naturally come back together, thereby closing flexible valve 63, i.e., by allowing channel 81 and valve orifice 68 to return to a closed position. The pressure of fluid within the packing cushion helps to force second valve panel 64 and first valve panel 66 together, thereby enhancing the sealing of the cushion. And thus, once the inflated cushion is no longer being acted upon by guide track 28, the cushion will be sealed. Any additional external pressure acting on the surfaces of the cushion will only increase the internal cushion pressure; this will consequently increase the pressure between second valve panel 64 and first valve panel 66, ultimately creating an even tighter seal against fluid leakage.

Accordingly, in some embodiments, flexible valve 63 substantially prevents fluid communication between interior cavity 83 and the ambient environment in the absence of exertion of a second force, e.g., second force 87*a* and/or 87*b*, on the valve 63. If the resultant self-seal, e.g., as produced by the action of the internal pressure within the inflatable container, is not sufficient, a small amount of a releasable/re-sealable adhesive substance, e.g., glycerin, mineral oil, repositionable adhesive, etc., may be placed between the first and second valve panels 66, 64, e.g., on one or both facing surfaces thereof, to ensure self-sealing after inflation. Such an adhesive coating would allow for the opening of the flexible valve under the action of second, e.g., lateral, forces, but would ensure the bond of second valve panel 64 to first valve panel 66 following inflation. Such a technique may be useful in the formation of a more permanent seal under low pressure conditions. For many, if not most, embodiments/end-use applications of the present invention, however, such use of a releasable adhesive will not be necessary.

In some embodiments, the flexible valve may contain two or more openings that fluidly communicate with the ambient environment in which the inflatable container is located upon the application of a second force, e.g., second force 87*a* and/or 87*b*. For example, the flexible valve 63 discussed thus far can be viewed as effectively acting as two valves. Because the flexible valve 63 includes of two valve openings 70*a* and 70*b* (see FIGS. 1 and 27) and two corresponding valve passageways from the openings to valve orifice 68, i.e., as provided by channel 81 between the first and second valve panels 66, 64, there is a built-in redundancy for the inflatable container 12. This may be advantageous, for example, in the event that channel 81 sticks or otherwise remains shut on one side of valve orifice 68. By having a second valve passageway, i.e., the opposing side of channel 81, successful inflation of the container may still be possible.

Advantageously, inflatable containers in accordance with the present invention may be constructed entirely of flexible materials, e.g., thermoplastic film materials as described above. Indeed, they can be constructed entirely of a single material, such as a polyethylene homopolymer or copolymer. The components of these containers may be flat (two-dimensional) and simple in construction, with the inflation arising not from forced injection of a fluid or from the expansion of a foam core or other rigid/semi-rigid structure; rather, inflation arises from the smooth and continuous interactions between a flexible, self-opening, self-sealing valve structure and a flexible housing. Optionally, a support structure may be employed, e.g., a guide track such as guide track 28; however, a support structure is not required for inflation (see below).

Following the inflation of one or a plurality of inflatable containers, the inflated containers can be used in a variety of packaging capacities. In the same way that packing cushions made with inflation and sealing machinery are utilized as a void fill, inflated containers in accordance with the present invention can also be utilized as packing cushions. Such cushions may be simply placed inside of a shipping carton along with any articles to be shipped; the cushions will then act to fill any voids between the articles and the inside walls of the shipping carton. When used in this manner, the cushions restrict the movement of the packaged articles within the carton, thereby reducing the possibility of damage to the articles while in transit. Additionally, the fluid-filled cushions may also act to protect the packaged articles by absorbing any impacts that would otherwise be transmitted entirely to the articles.

After use, the inflated containers, e.g., cushions, may be disposed of, reused, or recycled. When disposing of used packaging containers, the volume of the containers may be reduced dramatically by either rupturing the containers or by releasing the air from each container via the flexible valve 63. If an elongated object, such as a pen or the end of guide track arm 30*a* or 30*b*, is inserted into either valve openings 70*a* or 70*b*, the seal created by the flexible valve 63 can be temporarily broken. This action will lead to the release of air from the packing container, thereby deflating it. Alternatively, the inflated packing container can be fed back onto guide track arms 30*a* and 30*b*. The same lateral forces that conspired to open the flexible valve 63 during inflation can similarly re-open the flexible valve 63 for deflation. Once the valve is re-opened in this manner, the packing container can be flattened by pressing together first housing panel 60 and second housing panel 62. If future reuse of the packing containers is desired, the containers can be deflated by either of these "valve opening" methods and then stored until needed. When a packager wishes to re-inflate these deflated containers, she may place the containers back on guide track 28 and re-inflate them in the same manner with which they were originally inflated; alternatively, she can manually blow air into either valve opening 70*a* or 70*b* whereby the container will be inflated in a more conventional manner. Additionally, because the packing containers of the present invention can be made from a single material such as low-density polyethylene, recycling is another viable option.

The previous description teaches the structure and operation of one embodiment of the present invention. A variety of alternatives exist with regard, e.g., to the design of the flexible valve, the support structure, and flexible housing.

Figure 13A:
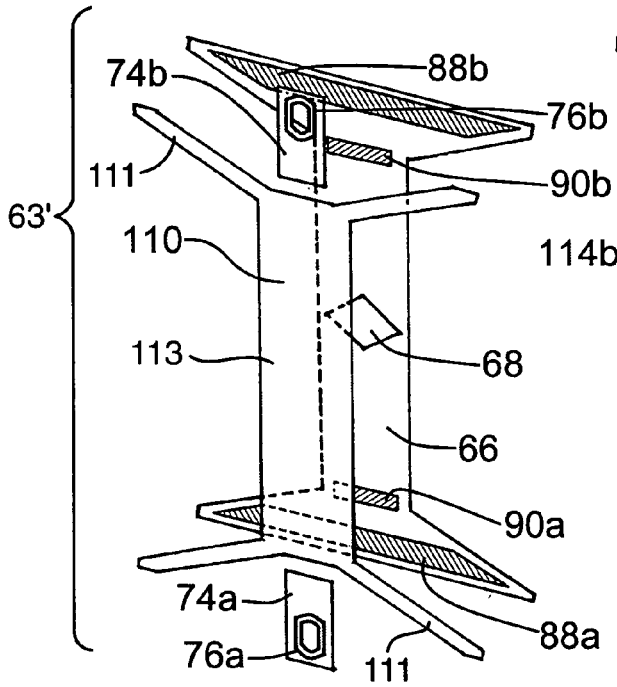
FIG. 13A is an exploded perspective view of an alternative embodiment of the flexible valve described in FIG. 4A and 4B.
Figure 13B:
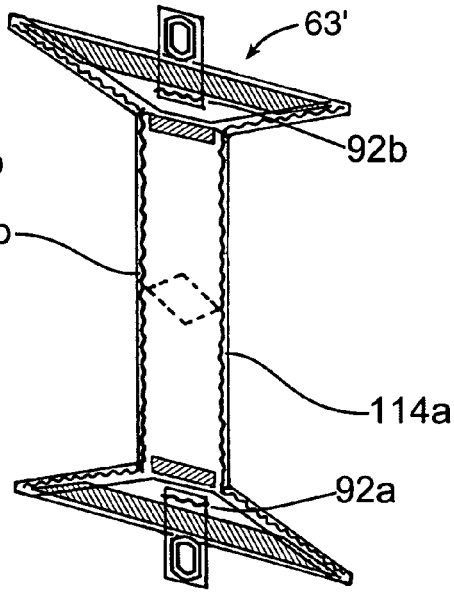
FIG. 13B is a collapsed perspective view of the components illustrated in FIG. 13A, illustrating the location of heat seal joints between the components.

FIGS. 13A and 13B show, for instance, an alternative embodiment of the flexible valve, which is indicated by the reference numeral 63'. In this embodiment, the second valve panel, labeled by the numeral 64 in FIGS. 4A and 4B, is altered. In FIG. 13A, the alternative shape of the second valve panel, labeled by the numeral 110 in this alterative embodiment, includes four thin "branches" 111 from the main "trunk" 113 of the second valve panel 110. Accordingly, alternative second valve panel 110 may be joined to first valve panel 66 along a greater fraction of their overlapping perimeters. Two heat sealed joints 114*a* and 114*b* pictured in FIG. 13*b* accomplish part of this union. When this alternative flexible valve is joined with second housing panel 62, as is illustrated in FIG. 8B, heat sealed joints 104*a*-104*d* will adhere second housing panel 62 to the alternative flexible valve along the "branches" 111 of second valve panel 110, which themselves are affixed to first valve panel 66. In this manner, the resultant cushion may have a decreased propensity to develop a fluid leak while in use.

Figure 14A:
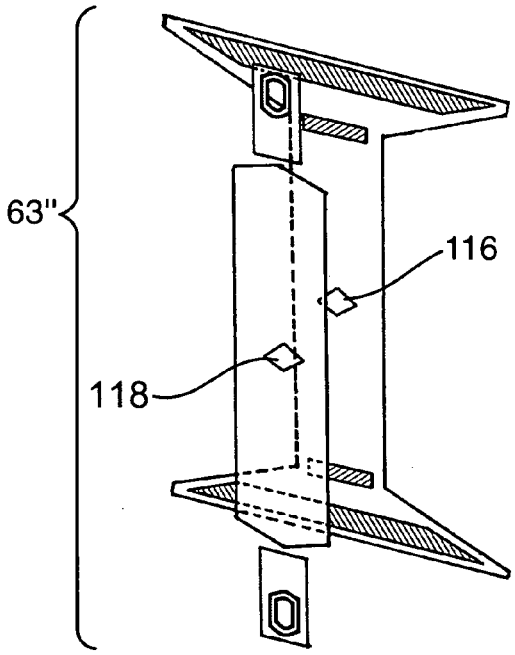
FIG. 14A is an exploded perspective view of another alternative embodiment of the flexible valve described in FIG. 4A and 4B.
Figure 14B:
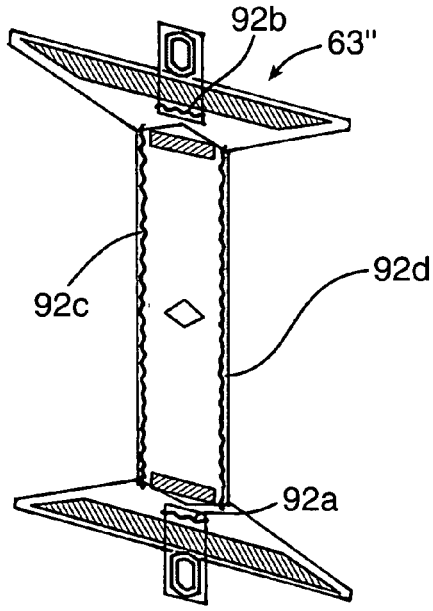
FIG. 14B is a collapsed perspective view of the components illustrated in FIG. 14A, illustrating the location of heat seal joints between the components.

Another alternative embodiment of the flexible valve is depicted in FIGS. 14A and 14B, and is designated by the reference numeral 63". In this embodiment, a valve orifice 116 in the first valve panel is smaller than valve orifice 68 of the embodiment pictured in FIG. 4A. Additionally, a second valve orifice 118 is made in the second valve panel of this alternative embodiment. This alternative embodiment demonstrates that the valve orifice need not be a particular size. Also, an additional hole can be made in the second valve panel without a corresponding loss of sealing capability. In some instances, a valve with holes made in both the first and second valve panels may allow for greater air flow into the interior 83 of the inflatable container 12.

Another variation on the flexible valve involves altering the shape of the valve orifice. Indeed, a wide variety of circular, elliptical and polygonal shaped holes can be substituted for the diamond shaped valve hole of the illustrated embodiments.

Figure 15A:
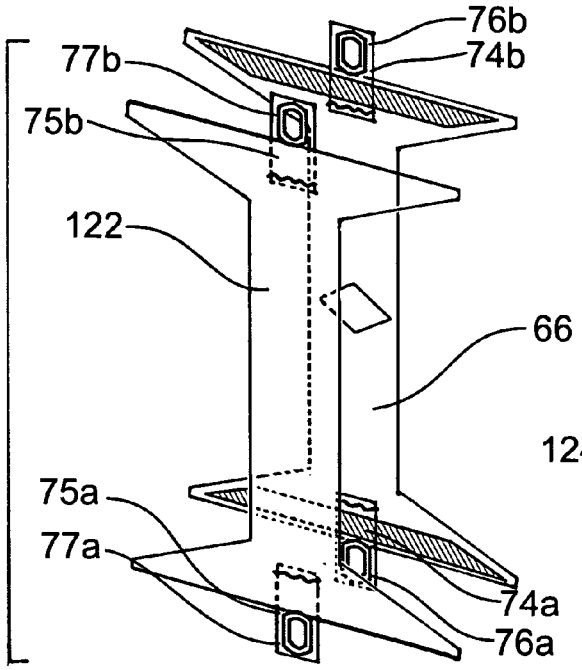
FIG. 15A is an exploded perspective view of another alternative embodiment of the flexible valve described in FIG. 4A and 4B.
Figure 15B:
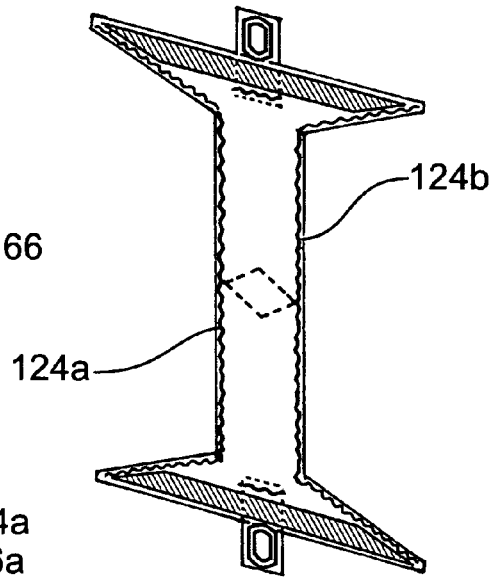
FIG. 15B is a collapsed perspective view of the components illustrated in FIG. 15A, illustrating the location of heat seal joints between the components.
Figure 15C:
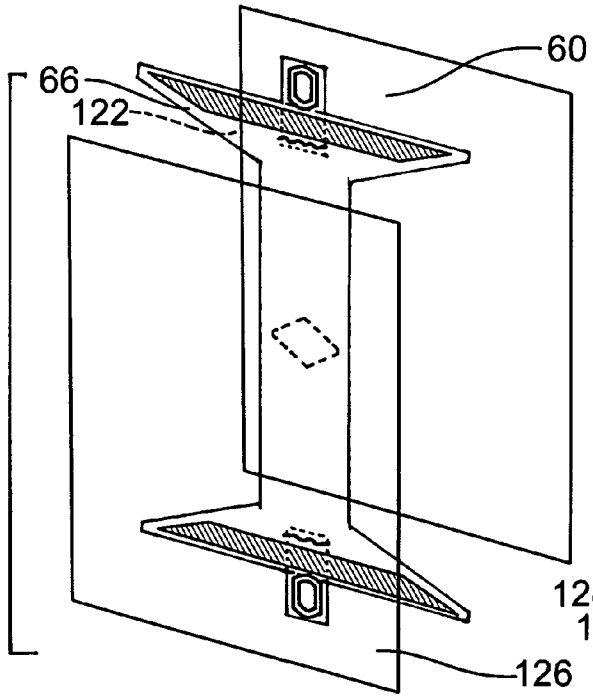
FIG. 15C is an exploded perspective view illustrating the incorporation of the alternative flexible valve illustrated in FIGS. 15A and 15B with the first housing panel and an alternative second housing panel.
Figure 15D:
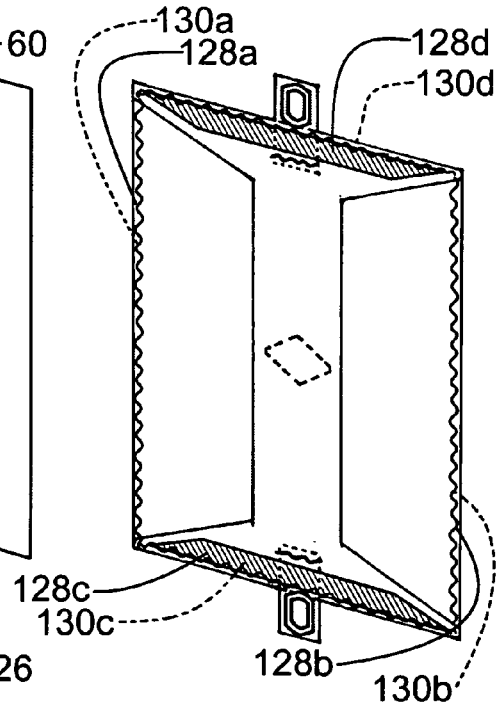
FIG. 15D is a collapsed perspective view of the components illustrated in FIG. 15C, illustrating the location of heat seal joints between the components.

Yet another alternative embodiment of the flexible valve is depicted in FIGS. 15A 15B, 15C, and 15D. In this embodiment, an alternative second valve panel 122 mirrors the general outline shape of first valve panel 66. Second valve panel 122 also has leading eyelet tabs 75*a* and 75*b* with incorporated leading eyelets 77*a* and 77*b* attached to its inner surface, as depicted in FIG. 15A. Second valve panel 122 may be joined to first valve panel 66 through the application of two heat sealed joints 124*a* and 124*b*. The alterative flexible valve that results from such a joining procedure is then incorporated within the main housing of an inflatable container, which may itself include an alterative second housing panel 126 and first housing panel 60 (FIG. 15C). In this regard, heat sealed joints 130*a*-130*d* may be employed to join first valve panel 66 to first housing panel 60, and also to join the two longer edges of second housing panel 126 to first housing panel 60 (FIG. 15D). These heat sealed joints may be applied from the first housing panel 60 through to the second housing panel 126. Similarly, heat sealed joints 128*a*-128*d* may be used to join second housing panel 126 to both second valve panel 122 and to first housing panel 60. This set of heat sealed joints may be applied from second housing panel 126 through to first housing panel 60. Both of these sets of heat sealed joints may follow roughly the same path along the perimeter of the top and first housing panel, essentially overlapping each other.

This embodiment may be advantageous from a manufacturing standpoint, since the alternative second valve panel 122 is nearly identical (and indeed can be made completely identical without significant design impact) to first valve panel 66. Therefore, fewer varieties of components need be produced.

Figure 16A:
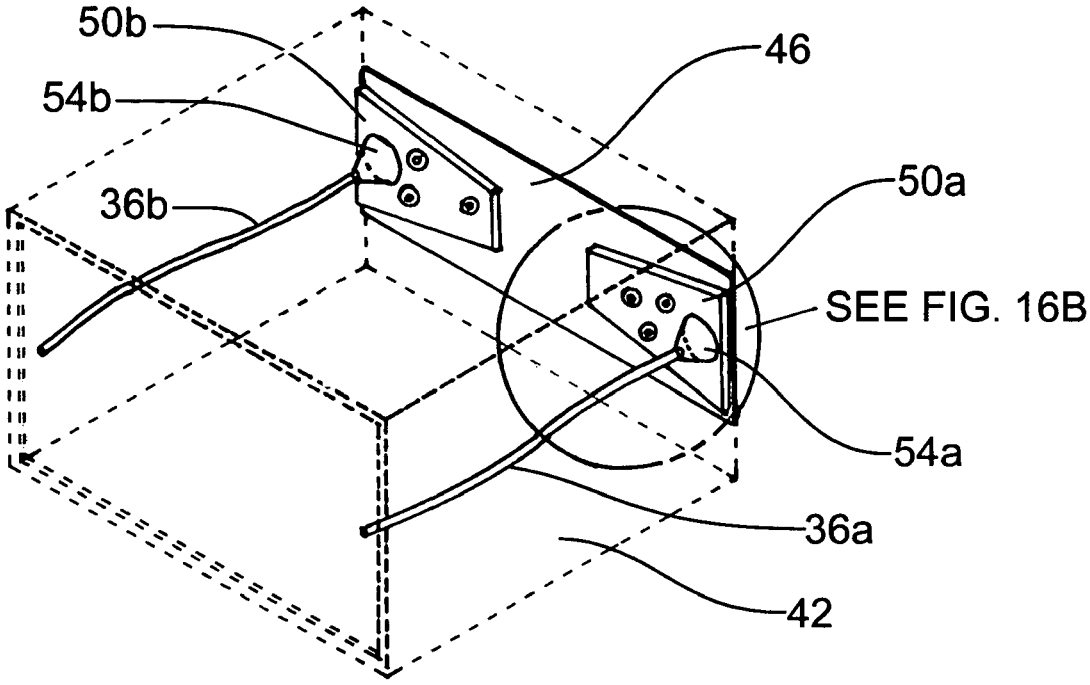
FIG. 16A is a perspective view of an alternative embodiment of the guide track. A method of affixing the alternative embodiment of the guide track to the inside of the box is also illustrated.
Figure 16B:
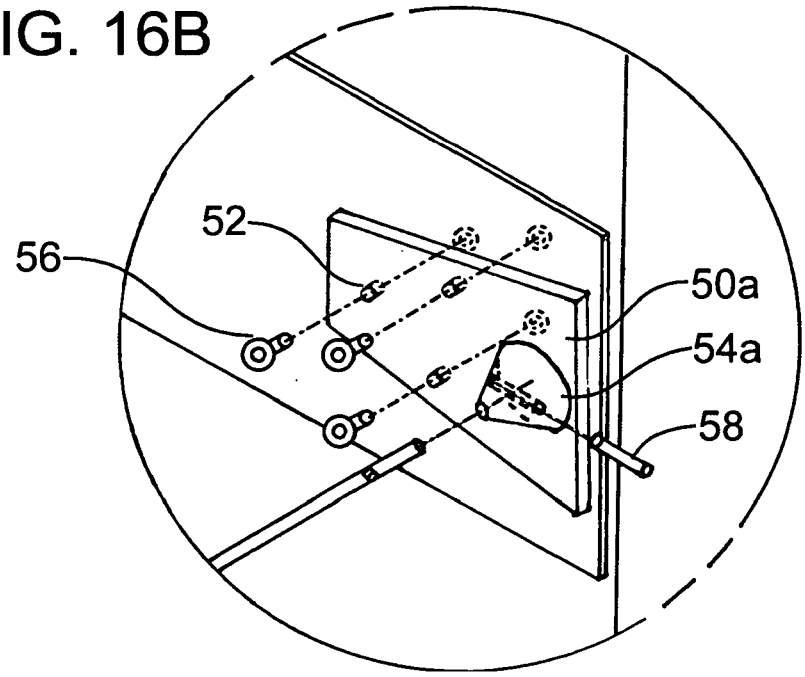
FIG. 16B is an enlarged, fragmentary detail of the area contained within the dotted circle in FIG. 16A.

A number of variations of the guide track and box assembly are possible, one of which is depicted in FIG. 16A. In this embodiment, the guide track is simplified to include only the guide track arms, which may be detachably mounted to a suitable support, e.g., a wall or box (as shown). In the figure, these detachable guide track arms are labeled as 36*a* and 36*b*. When arms 36*a* and 36*b* are detached and not connected to any other components, they may be fed through the eyelets of a stack of un-inflated packing cushions. This is most easily accomplished by feeding the stack of cushions onto the linear section of the arms, which in FIG. 16A is that section that lies nearest to box reinforcement 46. Detachable arms 36*a* and 36*b* may then be incorporated into box 42 or, e.g., onto a wall.

Following the loading of the packing cushions onto the linear section of detachable arms 36*a* and 36*b*, the arms can be connected to the back face of box 42. An associated connection mechanism is shown in detail in FIG. 16B. Base plates 50*a* and 50*b* are connected to both box reinforcement 46 and the back face of box 42 through the application of guide track fasteners 56. These guide track fasteners 56 can take on a variety of embodiments, such as nuts and bolts, rivets, or the like. Fasteners 56 are fed through base plate holes 52 and then secured, such as with a nut or pin. The base plates may include attached guide track stabilizers 54*a* and 54*b*. Stabilizers 54*a* and 54*b* help to securely connect the base plates 50*a* and 50*b* to the detachable guide track arms 36*a* and 36*b*. As pictured in the detailed, fragmentary view of FIG. 16B, after one of the detachable guide track arms is fed into the guide track stabilizer, a securing peg 58 may be used to lock the arms into the stabilizer.

Figure 17A:
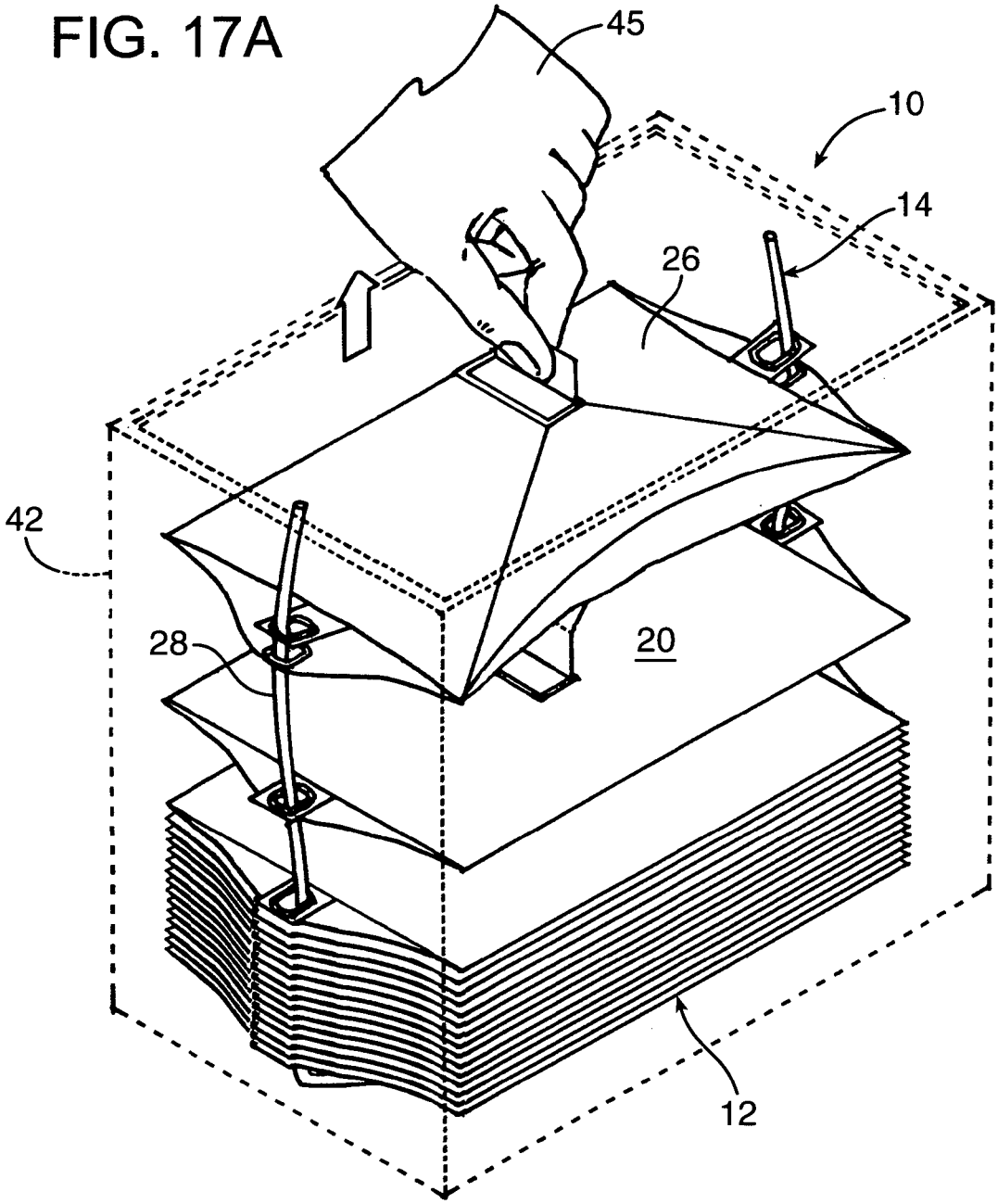
FIG. 17A is a perspective view of an alternative functional orientation of the preferred embodiment of the present invention.

A variety of alternative embodiments of the style and scale of the support structure 14 are also possible. For instance, FIG. 17A illustrates the embodiment shown in FIG. 1, wherein box 42 is oriented in an upright position rather than in the horizontal position shown in FIG. 1. This alternative positioning allows the packing cushions to be pulled upwards and out of box 42; this may be an important option to a packager concerned with the desk space required for a horizontally facing box 42.

The scale of the present invention can also be increased to accommodate a variety of packaging needs. FIG. 17B depicts a larger version of the present invention. In this version, the support structure is not enclosed by and attached to the inside of a box as described above. Instead, the support structure may comprise a free-standing support structure 14', including a base 131, upright stand 132, and a pair of guide track arms 133 extending from the upright stand, e.g., in a vertical orientation as shown. This free-standing structure 14' can sit on a counter-top, or if made tall enough, can rest directly on floor space. The user may pull containers 12 along the guide track arms 133 in a manner similar to that described above. As illustrated, the containers 12 may be pulled in a downward direction to effect their inflation.

Figure 17C:
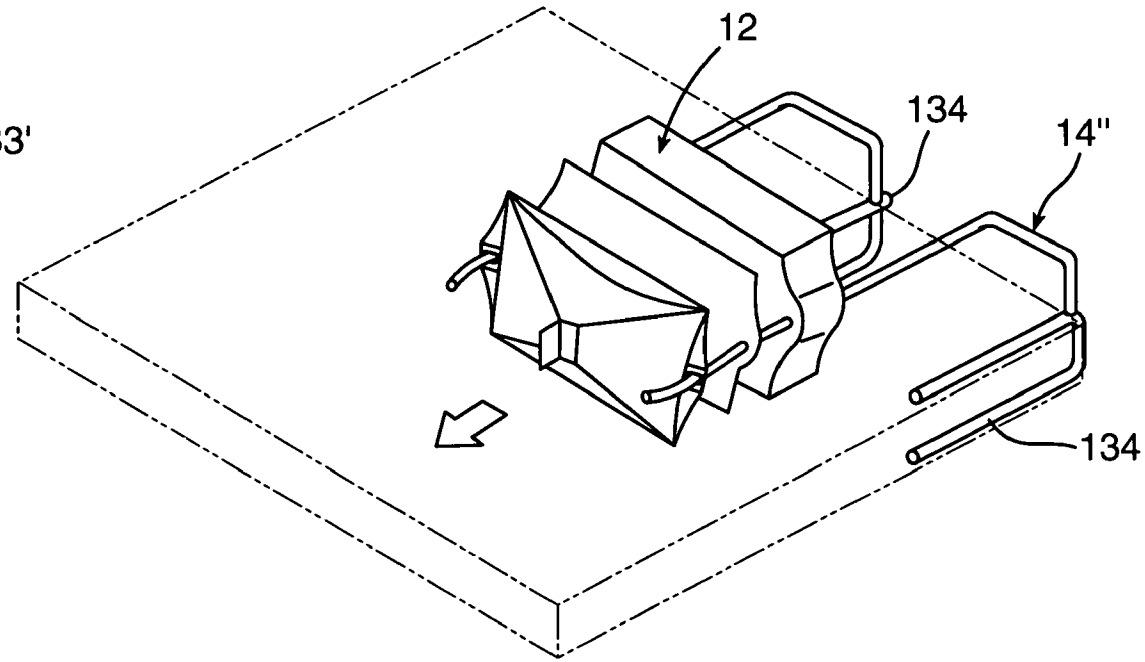
FIGS. 17B and 17C are perspective views of two alternative embodiments of the inflatable container holding structure and inflatable container inflating mechanism of the present invention.
Figure 17B:
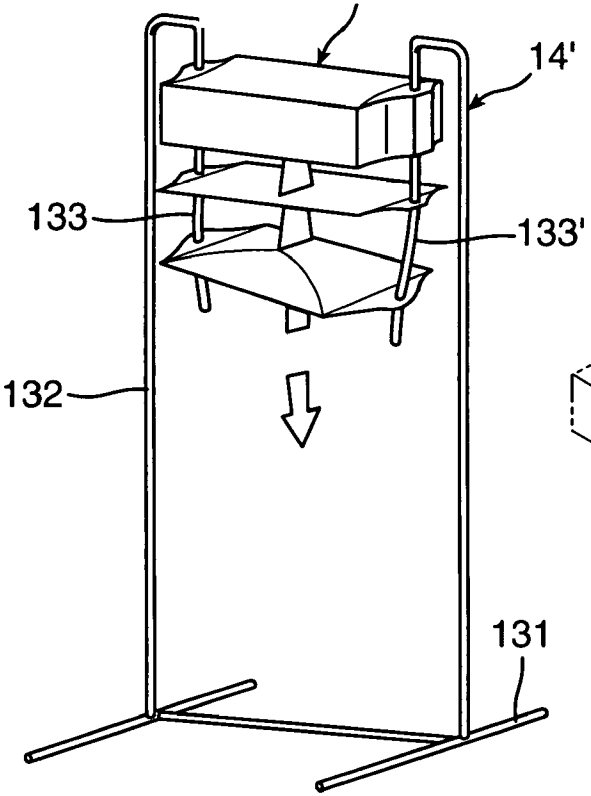

As another variation, support structure 14," pictured in FIG. 17C, is designed to rest on the edge of a countertop or desk (shown in phantom). It may be held in place by support brackets 134, which engage a lip or edge of countertop, desk, or other such object. This same embodiment can also be hung on a shelf, door, or the like, and be operated in a downward, vertically-oriented fashion as in FIG. 17B. As with support structure 14' shown in FIG. 17B, this variation can also be operated with a single hand, as the forward action of pulling containers 12 along the structure 14" is counteracted by support brackets 134, which secure the structure to the countertop or desk.

Figure 18:
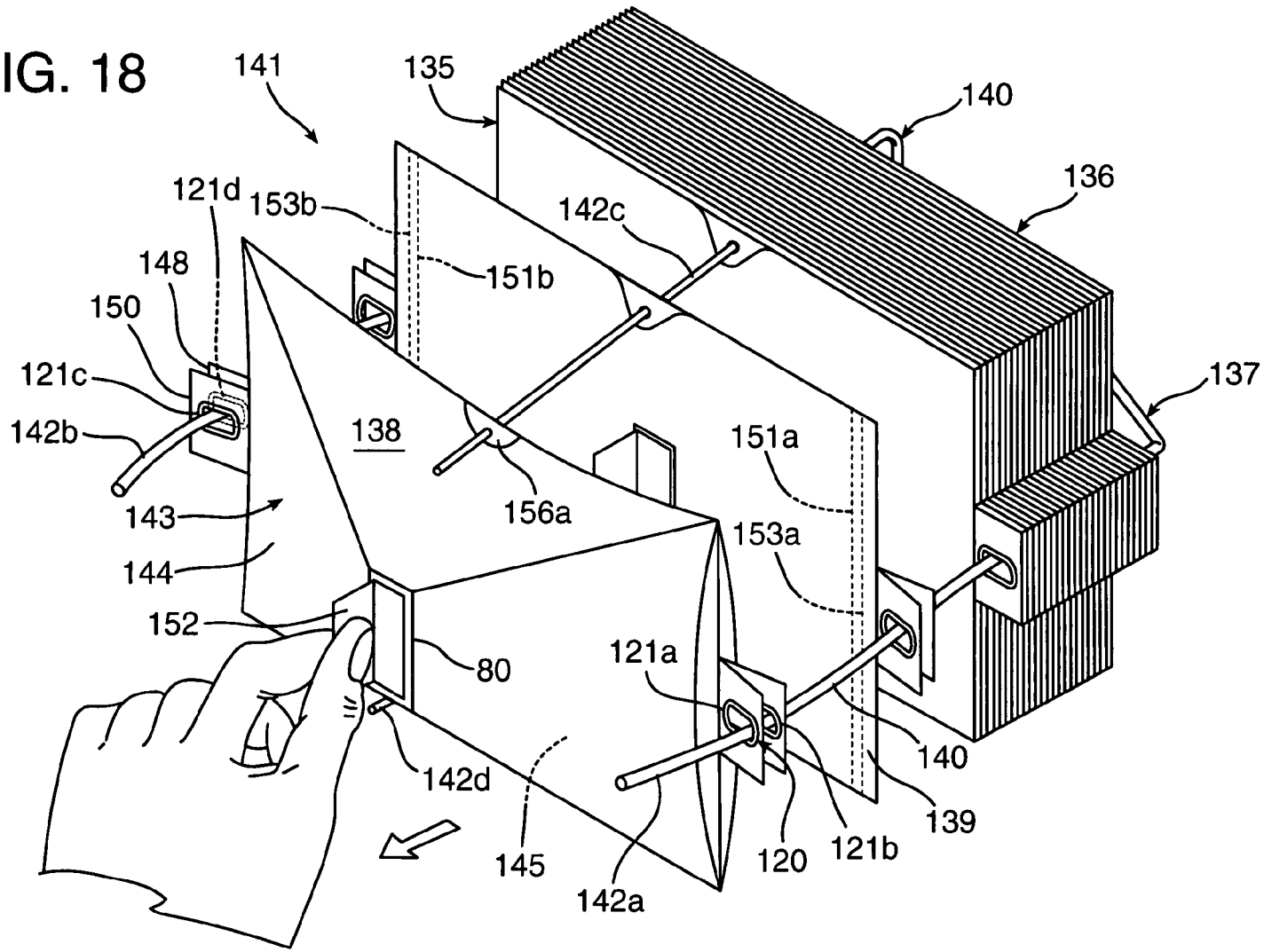
FIG. 18 is a perspective view of an alternative embodiment of the present invention, namely a plurality of separate, unconnected inflatable containers positioned on an alternative support structure of the present invention.

Another alternative embodiment of the present invention is depicted in FIG. 18. In similar manner to FIG. 1, FIG. 18 depicts an inflatable container system 141, comprising a plurality of alternative inflatable containers 135 and a support structure 137. Similar to inflatable containers 12, inflatable containers 135 include a flexible housing (143) and a flexible valve (120), and operate in accordance with the same general principles as described above in connection with inflatable containers 12. Thus, containers 135 may be inflated by exerting a first force on the housing 135 and exerting a second force on valve 120, such that the housing and valve each undergo a change in shape to draw fluid from the ambient environment, through the valve, and into the interior cavity 145 of the housing.

As with the embodiment described in connection with FIG. 1, inflatable containers 135 may also be adapted for use as packing cushions, and may take the form of un-inflated packing cushion 139, a stack of un-inflated packing cushions 136, and a packing cushion undergoing inflation 138, all of which are identical in construction and differ only in their states of inflation.

In this embodiment of the container, the flexible valve, indicated at 120, is entirely integrated with eyelets 121*a*-*d* (see also FIG. 19), negating the necessity of eyelet tabs, as in previously described embodiments. As illustrated, eyelets 121*a, c* may be termed "leading" eyelets, in that they precede "trailing" eyelets 121*b, d* as the containers 135 are pulled along support structure 137.

Flexible valve 120 comprises a first valve panel 150 and a second valve panel 148. The valve 120 functions by the same principles, namely opening via application of lateral force (i.e., a "second" force), as the flexible valves of the previously described embodiments. As such, valve 120 is preferably also a substantially self-sealing valve, i.e., after the container 135 has been inflated. In some embodiments, flexible valve 120 may have a rectangular shape as shown. This may be advantageous, from a manufacturing standpoint, by allowing cutting waste, e.g., of the thermoplastic film from which the valve is constructed, to be minimized during fabrication of the valve. Also, because flexible valve 120 may include integral eyelets 121*a-d*, manufacturing steps involving the fabrication, placement, and heat joining of eyelet tabs of previously-described embodiments may be avoided.

In this embodiment, a different support structure 137 may be used. Specifically, support structure 137 may take the form of guide track 140 as shown. Guide track 140 may include four guide track arms, 142*a*-142*d*, rather than the two arms of previously-described embodiments. Accordingly, inflatable containers 135 may include midline holes 156*a, b* in the flexible housing 143 of each container (see, also, FIGS. 24-25). Guide track arms 142*a* and 142*b* may be fed through the incorporated eyelets 121*a-d* of flexible valve 120. Guide track arms 142*c* and 142*d* may be fed through midline holes 156*a* and 156*b* of flexible housing 143. The use of additional guide track arms and holes, i.e., arms 142*c, d* and midline holes 156*a, b*, may be advantageous in some embodiments to provide additional stabilization to the containers during inflation, e.g., for larger-sized containers.

As with inflatable containers 12, containers 135 may be inflated by mounting the container on support structure 137 such that the container can move on the support structure. Inflation can then be effected by moving a container 135 on the support structure 137, e.g., by pulling the container as shown in FIG. 18, to exert a first force on flexible housing 143 to change the shape thereof, and exerting a second force on flexible valve 120 to change the shape thereof, e.g., by virtue of attaching opposing ends of the flexible valve to diverging guide track arms 142*a, b* of the support structure, which exert a tensioning force on the valve as the container is moved along the support structure. In this manner, the flexible housing 143 changes shape, e.g., expands, to produce less-than-atmospheric pressure within interior cavity 145. At the same time, flexible valve 120 changes shape to provide a fluid-communication channel between the ambient environment and the interior cavity. As a result, the housing and valve cooperate to draw fluid from the ambient environment, through the valve, and into the interior cavity.

In this embodiment, the inflatable containers 135 are not connected with one another. Instead, each container may be equipped with a reinforcement patch 80 and a discrete, i.e., un-connected, pull tab 152. As may thus be appreciated, inflatable containers in accordance with the present invention, and in accordance with any of the embodiments described herein, may be connected, or may be designed without container-to-container connections as desired to suit the intended end-use application. For instance, for high-volume container use, e.g., in company mail-rooms, it may be advantageous for the containers to be connected, as this may facilitate the speed at which a plurality of containers can be inflated, i.e., by pulling a 'string' of inflating/inflated containers off of the support structure. In other applications, e.g., home use, inflation of one container at a time may be more typical, in which case it may be more appropriate for the containers to be un-connected.

Figure 19:
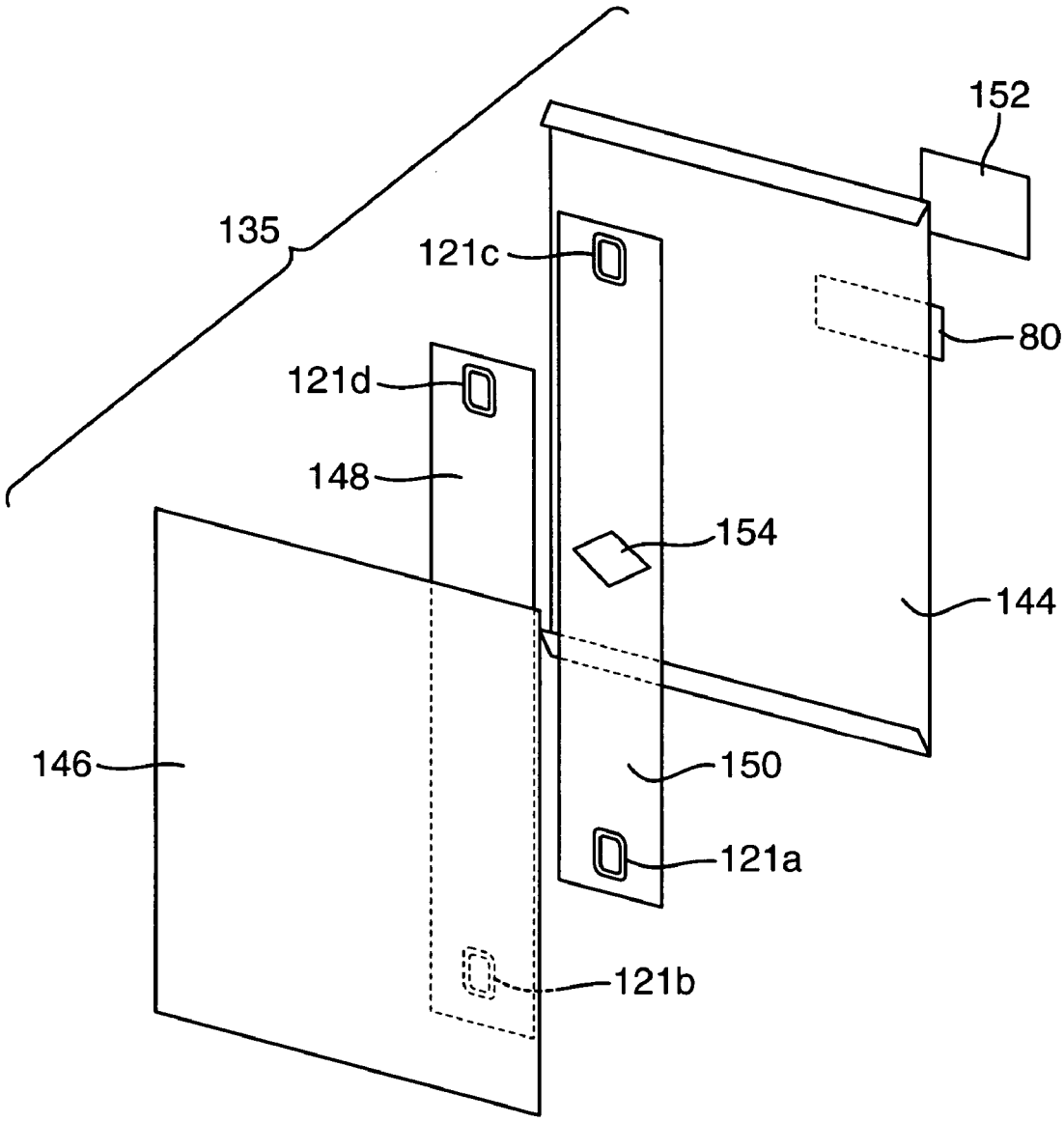
FIG. 19 is an exploded perspective view of an alternative embodiment of an inflatable container of the present invention, illustrating the relative arrangements of all inflatable container components.

FIG. 19 shows an exploded perspective view of a single inflatable container 135 of the embodiment depicted in FIG. 18 (minus the optional midline holes 156*a, b*). This view illustrates a relative arrangement of the components of the container.

FIGS. 20A-23B collectively illustrate an order and manner in which the components of inflatable containers 135 may be assembled and joined together to form the completed un-inflated container 135.

Figure 20B:
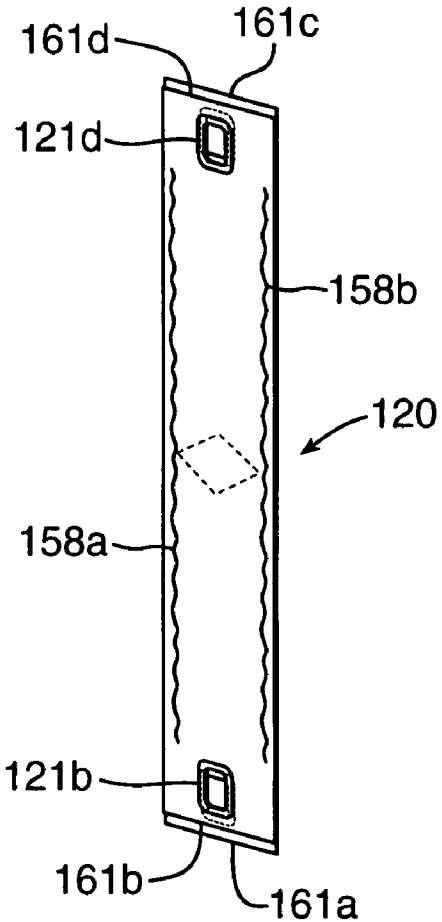
FIG. 20B is a collapsed perspective view of the components illustrated in FIG. 20A, illustrating the location of heat seal joints between the components.
Figure 20A:
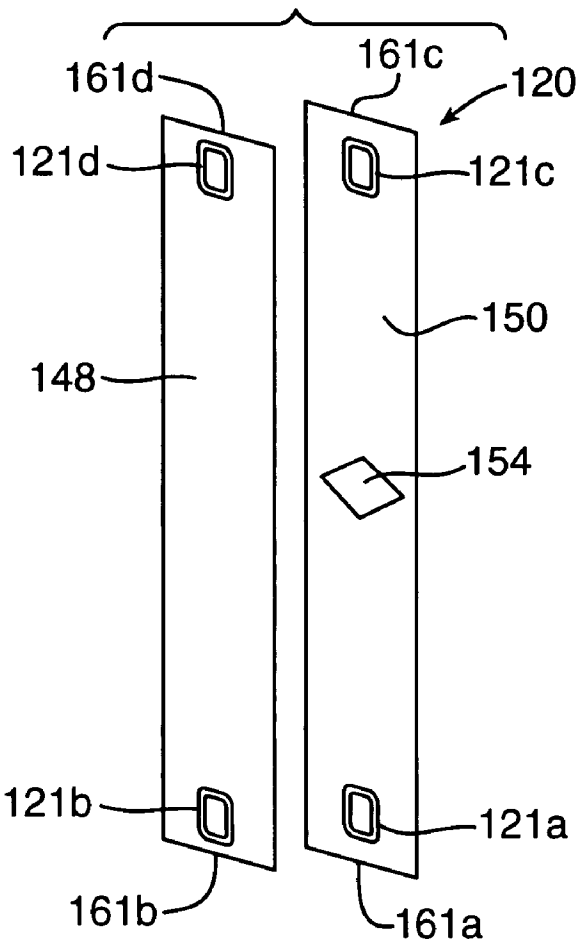
FIG. 20A is an exploded perspective view of the valve assembly of an alternative embodiment of the present invention.

FIGS. 20A and 20B together teach a first assembly step, in which the second valve panel 148 and the first valve panel 150 (with a valve orifice 154) may be joined by two approximately parallel heat sealed joints 158*a*, b along a portion of their longest edges. Eyelets 121*a-d* may be incorporated into the valve panels 148 and 150, e.g., by cutting or punching appropriately-sized holes in the panels, which may have a round, elliptical, or rounded-rectangular shape as shown, or any other geometric or non-geometric/random shape as desired. The eyelets 121*a-d* may be non-reinforced or reinforced, e.g., through heat-induced cauterization of the film immediately surrounding the holes, as desired or necessary to suit the end-use application.

Figure 28:
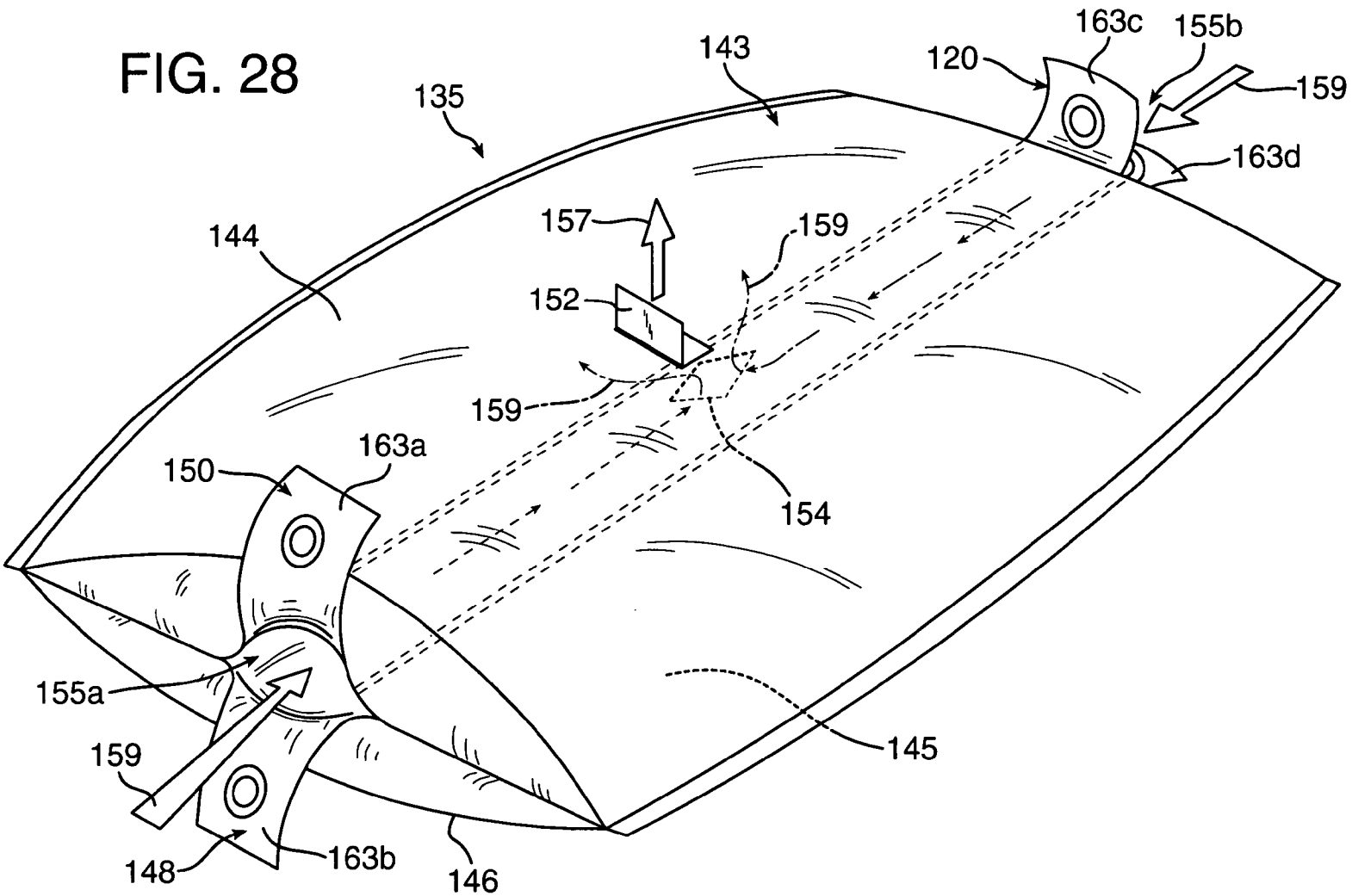
FIG. 28 is a side view of an inflatable container as shown in FIG. 18, wherein fluid from the ambient environment is entering the container via valve openings in the flexible valve.

As shown, heat seals 158*a, b* preferably do not extend to the edges 161*a-d* of the first and second valve panels 150, 148. In this manner, valve flaps 163*a-d* may be created, as illustrated in FIG. 28.

As also shown, second valve panel 148 may be slightly shorter than the first valve panel 150, so that 'leading' eyelets 121*a, c* are slightly outboard of 'trailing' eyelets 121*b, d*. As explained above, this difference in length between the two valve components allows leading eyelets 121*a, c*—and therefore the edges 161*a, c* of first valve panel 150—to travel slightly ahead of trailing eyelets 121*b, d*—and therefore the edges 161*b,d* of second valve panel 148—along the track arms 142*a* and 142*b*. This spacing facilitates opening of the flexible valve 120 at valve openings 155*a, b*, by allowing valve flaps 163*a, b* to separate from one another (for valve opening 155*a*) and valve flaps 163*c, d* to separate from one another (for valve opening 155*b*), as shown in FIG. 28.

Figure 21B:
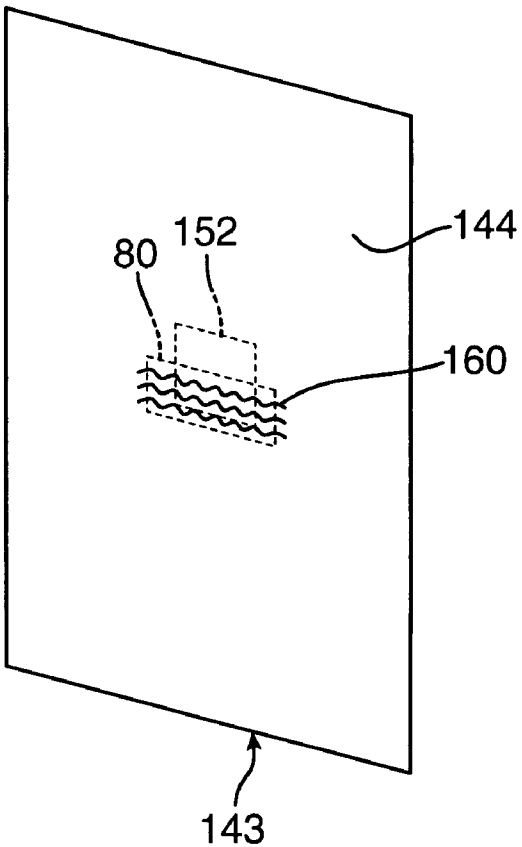
FIG. 21B is a collapsed perspective view of the components illustrated in FIG. 21A, illustrating the location of heat seal joints between the components.
Figure 21A:
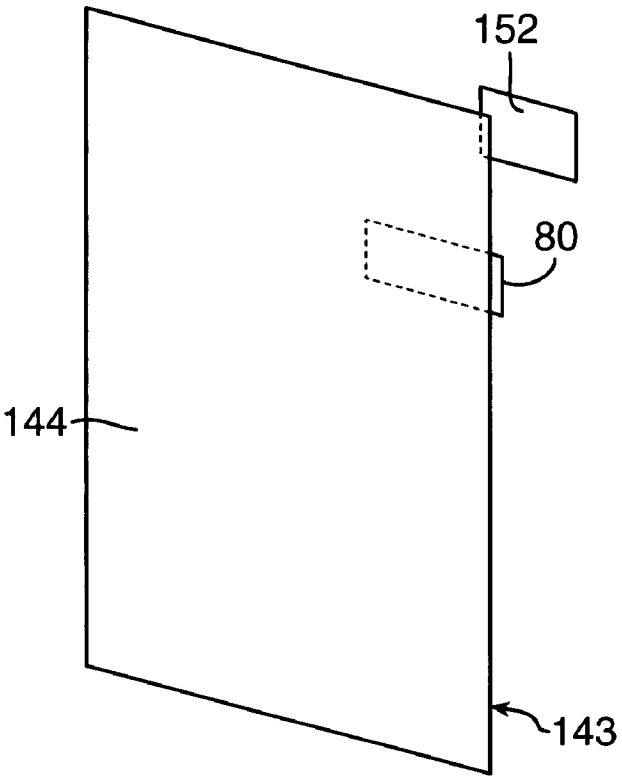
FIG. 21A is an exploded perspective view of a bottom housing, a bottom reinforcement patch, and a pull tab of an alternative embodiment of an inflatable container of the present invention.

FIGS. 21A and 21B together teach a second assembly step, which may be executed in parallel with the aforementioned first step. In similar fashion to the steps described in other embodiments, this manufacturing step involves the joining, if desired, of reinforcement patch 80 to first housing panel 144. Additionally, a pull tab 152 may then be joined to the reinforcement patch. A heat sealed joint 160 can accomplish the necessary fixture; of course, adhesives could be used in lieu of heat sealing. Also, as has been noted elsewhere in this document, the reinforcement patch 80 may not be necessary; the pull tab 152 can instead be joined directly to the first housing panel 144, e.g., if long-term durability or repeated usage is not required.

Figure 22B:
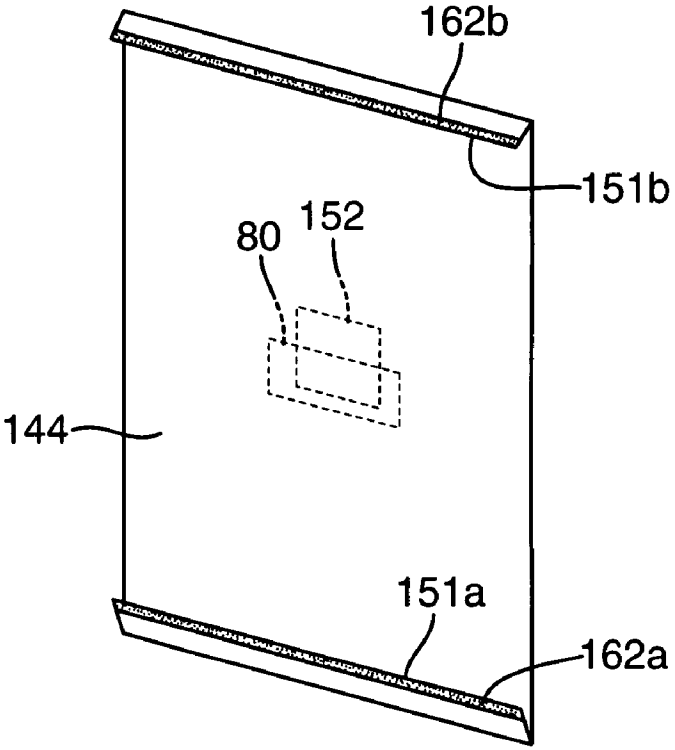
FIG. 22B is a perspective view of the assembly of FIG. 22A, with applied adhesive and ends folded.
Figure 22A:
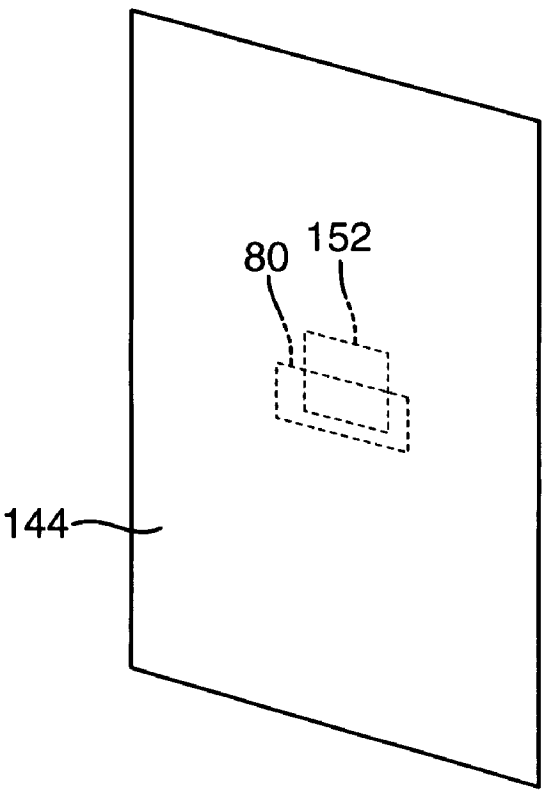
FIG. 22A is a perspective view of the assembly of FIG. 21B.

FIGS. 22A and 22B together teach a third assembly step, which may follow the steps described in reference to FIG. 21B. This step involves the folding of a margin of two opposing edges 151*a, b* of first housing panel 144. Prior to this step, or following it, two ribbons 162*a, b* of cohesive or adhesive material, e.g., UV curable adhesive, may be applied to the folded margins of first housing panel 144 at edges 151*a, b* as shown (FIG. 22B).

Figure 23B:
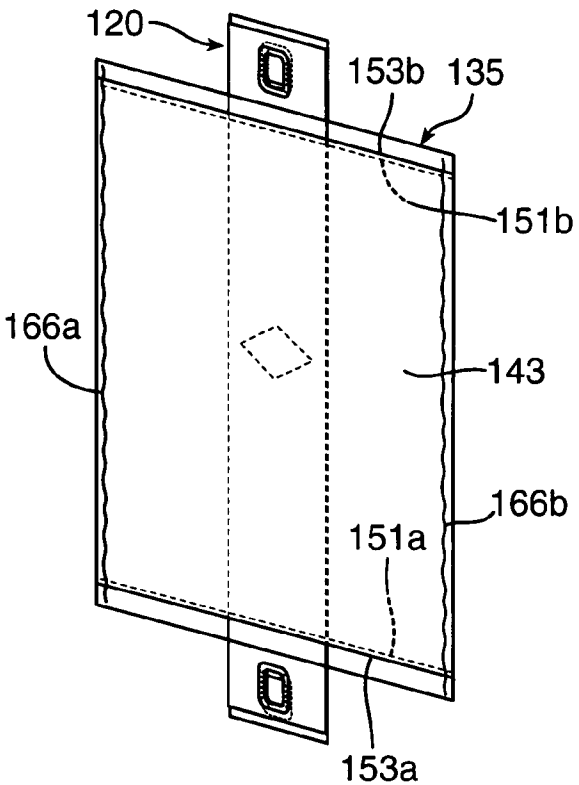
FIG. 23B is a collapsed perspective view of the components illustrated in FIG. 23A, illustrating the location of heat seal joints between the components, as well as the joining of sections along adhesive coated regions.
Figure 23A:
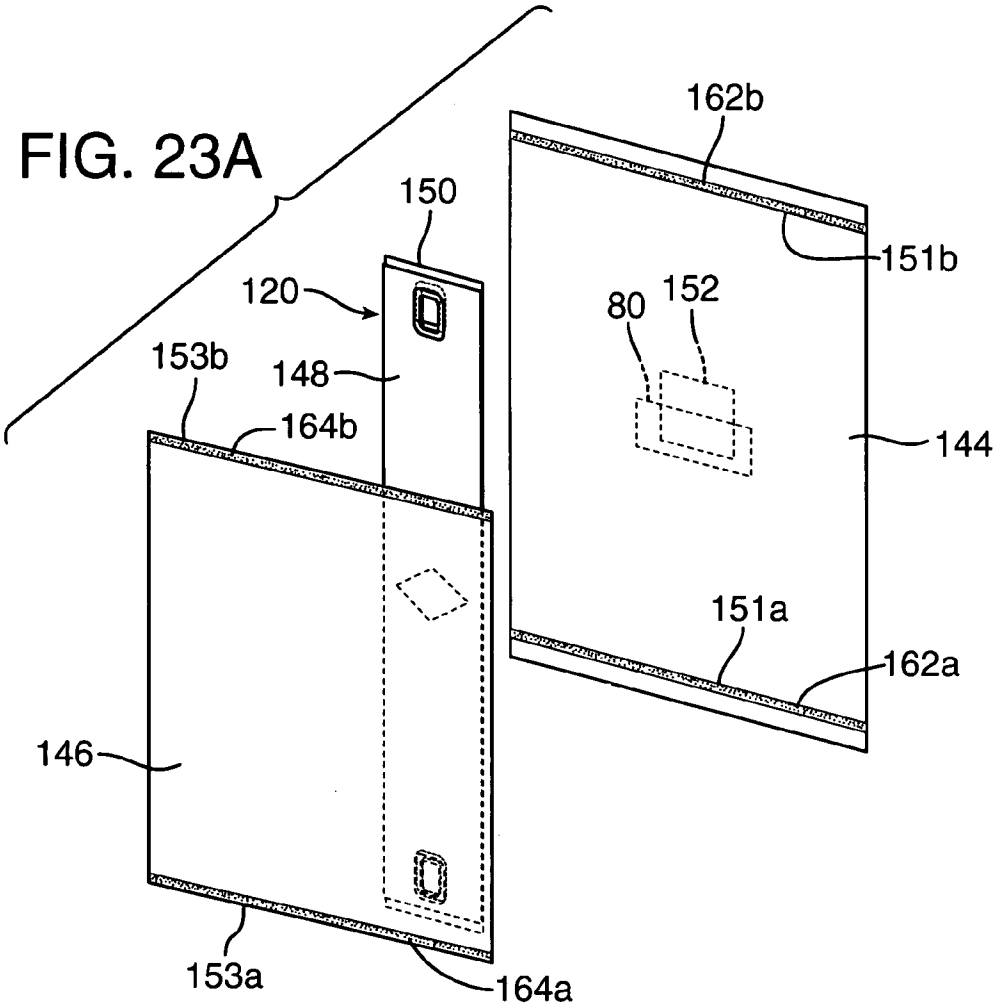
FIG. 23A is an exploded perspective view of a top housing, the valve assembly of FIG. 20B, and the bottom housing assembly of FIG. 22B of the alternative embodiment of the inflatable container of the present invention.

FIGS. 23A and 23B together show the final assembly step, in which all components are assembled. The flexible valve 120 described in FIG. 20B is placed between the second housing panel 146 and the first housing panel 144. The second housing panel 146 may optionally be coated with two ribbons of adhesive 164*a* and 164*b* at edges 153*a, b*, which may align with the adhesive ribbons 162*a, b* applied to the folded margins at edges 151*a, b* of first housing panel 144. The components may then be fed into a press and a cure station, wherein the adhesive ribbons 162*a*, 162*b*, 164*a*, and 164*b* are activated and join edges 151*a, b* of first housing panel 144 to edges 153*a, b* of second housing panel 146. Additionally, the adhesive ribbons 164*a, b* join second housing panel 146 to second valve panel 148. Likewise, adhesive ribbons 162*a, b* join the mid-section of the folded edges 151*a, b* of first housing panel 144 to first valve panel 150.

The margin folds at edges 151*a, b* of first housing panel 144, depicted in FIG. 22B, may be advantageous in some embodiments. Such folds provide a gusset-like feature, which allows the first housing panel 144 and the second housing panel 146 to pull away from each other during inflation of the inflatable container 135, thereby increasing the internal container volume that is available for fluid-intake during inflation.

The remaining two unjoined edges of the housing panels 144, 146 can be joined, e.g., through heat-sealed joints 166*a* and 166*b*. Alternatively, second housing panel 146 and/or first housing panel 144 could be coated with additional ribbons of adhesive at such edges to form seals 166*a, b* as shown. In such a manner, the two remaining edges of the second housing panel 146 could be adhered to the edges of first housing panel 144 in the same adhesive press and cure step as described above, i.e., in which the flexible valve 120 is joined to the housing panels 144, 146. All such steps preferably result in an inflatable container interior that is separate and sealed from the ambient environment, connected only through the channel provided by the flexible valve 120.

FIG. 28 provides an illustration of how inflatable container 135 may inflate, from the perspective of valve opening 155*a* (a perspective view of opposing valve opening 155*b* would be identical). When first force 157 is exerted on flexible housing 143, e.g., manually via pull tab 152, the housing changes shape as shown. Simultaneously, when a second force is exerted on flexible valve 120, e.g., via support structure 137 (not shown for clarity), it changes shape as well and allows valve openings 155*a, b* to assume an open position. As shown, the separation of valve flaps 163*a, b* may facilitate the exposure of valve opening 155*a* as it assumes an open position. Similarly, the separation of valve flaps 163*c, d* may facilitate the exposure of valve opening 155*b* as it assumes an open position. As a result, fluid 159 from the ambient environment, e.g., air, is drawn into the valve openings 155*a, b* as shown, whereupon it flows through valve 120 and enters interior cavity 145 of flexible housing 143 to inflate such housing, as also shown.

Figure 24:
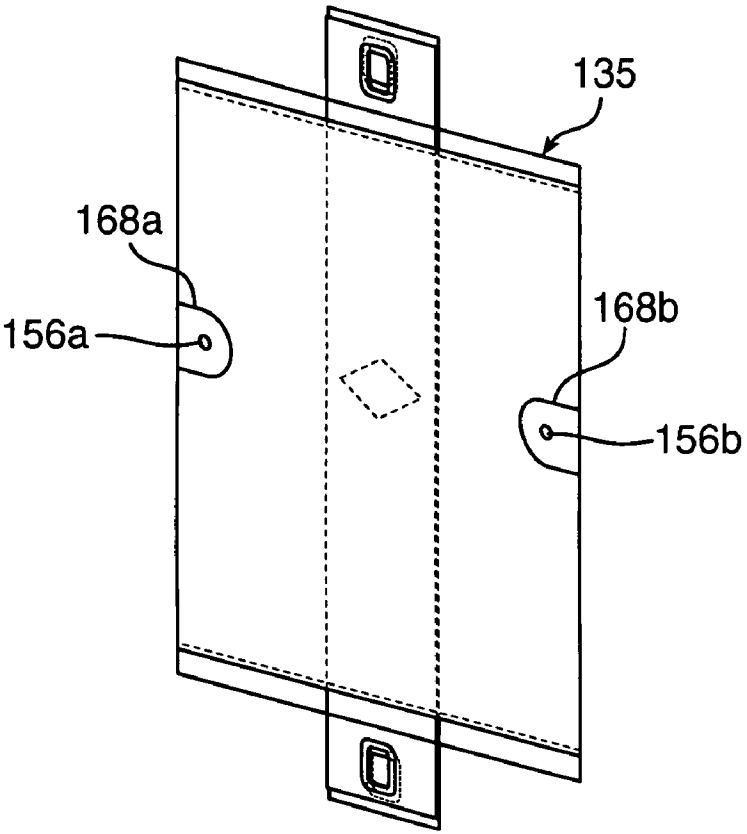
FIG. 24 is a perspective view of the completed assembled inflatable container of FIG. 23B, with punched midline holes and isolating heat seal joints.

FIG. 24 depicts an optional manufacturing step following the assembly of the inflatable container 135, in which two midline holes 156*a* and 156*b* are cut through the second housing panel 146 and the first housing panel 144 simultaneously. The holes 156*a* and 156*b* may then be surrounded by heat sealed joints 168*a* and 168*b* respectively, so as to maintain the fluid-retaining qualities of the inflatable container. Such mid-line holes 156*a, b* may be included when using a '4-arm' support structure such as, e.g., support structure 137 (FIG. 18).

Figure 25:
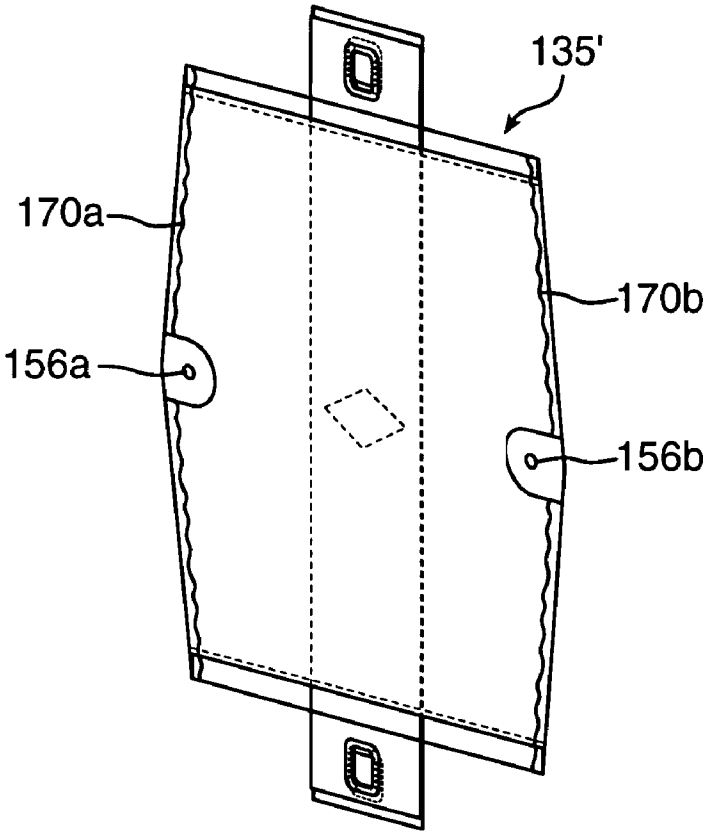
FIG. 25 is a perspective view of the completed assembled container of FIG. 23B, with punched midline holes, isolating heat seal joints, and trimmed cushion edges.

FIG. 25 depicts a further optional manufacturing step following the assembly of the inflatable container, in which, in addition to the formation of midline holes 156*a, b*, the corners of the inflatable container are trimmed off and sealed by heat sealed joints 170*a* and 170*b*. A more-or-less hexagonal-shaped inflatable container 135' then results, which has the advantage of appearing more inflated to the end user, despite retaining roughly the same amount of air as an inflatable container without trimmed corners. This advantage of appearances may be desirable, depending, e.g., on market urges, end-user preferences, etc.

As noted above in connection with the embodiment depicted in FIG. 1, inflatable containers in accordance with the present invention may be fabricated from pre-cut film.

Figure 26:
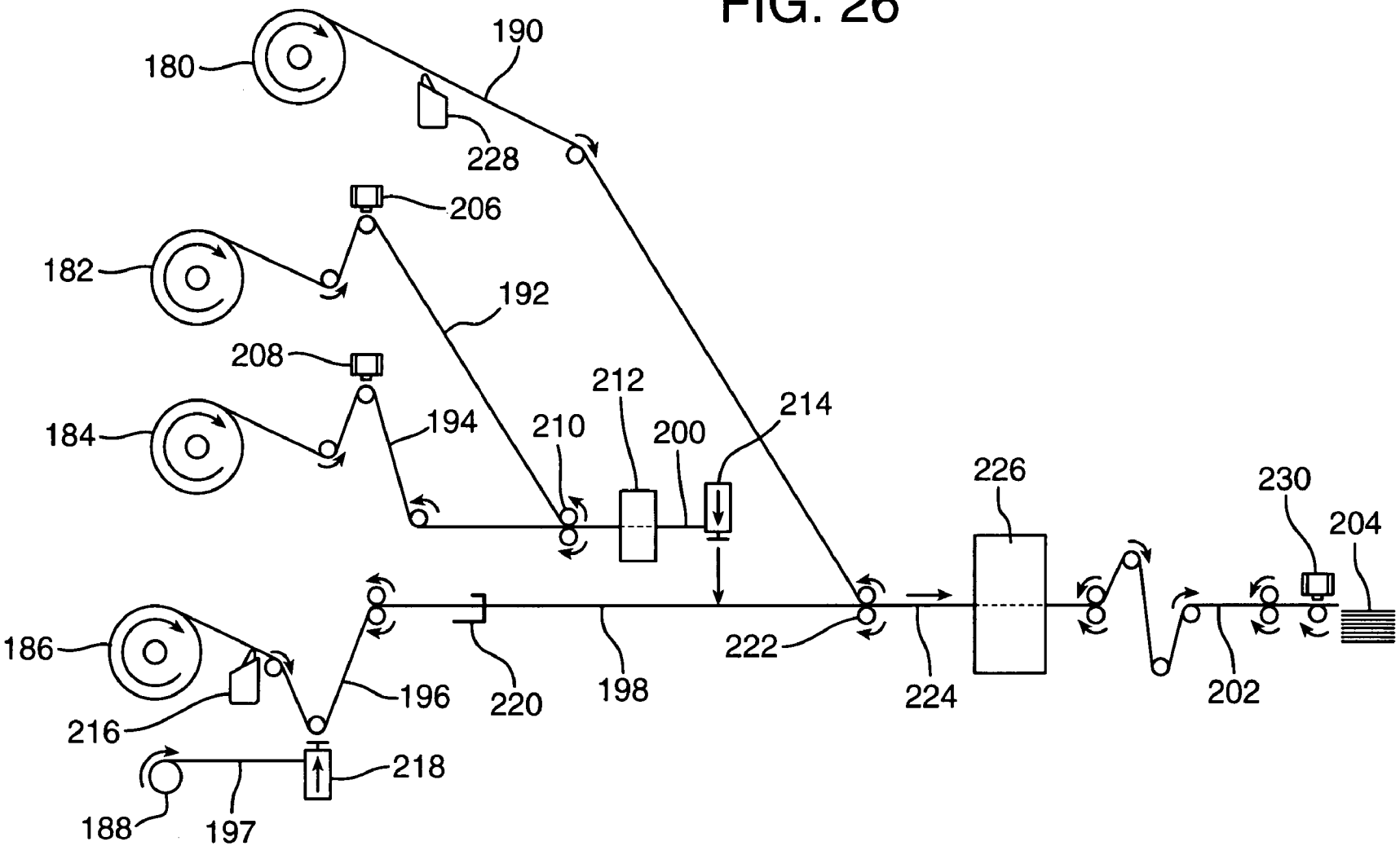
FIG. 26 is a schematic view of an assembly process for making containers as shown in FIGS. 18-25.

Alternatively, inflatable containers may be continuously or semi-continuously assembled by using webs of varying width, which correspond to each container component. The webs may be assembled, cut, and then sealed into a desired inflatable container configuration as a final step. FIG. 26 schematically illustrates such a process.

Specifically, FIG. 26 is a schematic illustration of a manufacturing process to produce inflatable containers 135 as shown in FIGS. 18-25. Unwind mandrils 180, 182, 184, and 186 may each contain a continuous web of film 190, 192, 194, and 196, respectively. Each web of film corresponds to a particular component of inflatable container 135. In the illustrated process, web 190 corresponds to second housing panel 146; web 192 corresponds to second valve panel 148; web 194 corresponds to first valve panel 150; and web 196 corresponds to the unfolded first housing panel 144. Additionally, unwind mandril 188 may contain a relatively thin web of film 197, which corresponds to pull tab 152.

As shown, the flexible valve 120 (depicted in FIG. 20B) may be assembled in a separate, e.g., parallel, sub-process. Specifically, web 192 (which forms second valve panel 148) may be directed through a punch cutter station 206, in which eyelets 121*b* and 121*d* may be formed in web 192, e.g., as a series of parallel holes at both longitudinal edges of the web. Similarly, web 194 (which forms first valve panel 150) may be directed through a punch cutter station 208, in which eyelets 121*a* and 121*c* may be formed in web 194, e.g., as a series of parallel holes at both longitudinal edges of the web. If desired, eyelets 121*a-d* may also be cauterized or otherwise reinforced in stations 206 and 208.

After emerging from stations 206, 208, respective webs 192, 194 may be merged via nip rollers 210, and then joined together, e.g., via a series of transverse, parallel heat seals 158*a, b* (FIG. 20B), in sealing station 212. The resultant web 200 is effectively a plurality of parallel, connected flexible valves 120. Web 200 may then be directed to a 'cut-and-place' station 214, which cuts individual flexible valves 120 from web 200 and places them, e.g., onto web 198 as shown.

In a separate, e.g., parallel, step, adhesive or cohesive strips 162*a*, b may be applied to the underside of web 196 (corresponding to the unfolded first housing panel 144) along both longitudinal edges thereof (which correspond to edges 151*a, b*; see FIG. 23) by an adhesive or cohesive applicator 216. Similarly, pull tabs 152 may be cut from web 197 and applied, e.g., via heat-sealing, to the underside of web 196 by cutter/applicator 218. Edges 151*a, b* may then be folded via edge folding device 220, thereby producing folded web 198. As depicted in FIGS. 22-23, edges 151*a, b* are preferably folded such that adhesive or cohesive strips 162*a, b* are brought into facing relationship with flexible valves 120 on web 200, and with second housing panels 146 on web 190.

At 'cut-and-place' station 214, flexible valves 120 are cut from web 200 and placed on the folded web 198. Web 190, which may have a pair of adhesive or cohesive strips 164*a, b* applied to longitudinal edges 153*a, b* via applicator 228, is then merged with the flexible valves 120 on web 198 via nip rollers 222. The combined web 224 may then be fed into a curing and/or heat-sealing module 226, wherein the assembly step depicted in FIG. 23A and 23B is completed to produce a web 202 of connected, assembled inflatable containers. Web 202 may then be transversely cut at cutting station 230, to yield individual inflatable containers 135, which may then be placed into a stack 204. A stack of containers 135, such as stack 204, may then be loaded onto a support structure, such as support structure 137 as shown in FIG. 18.

If desired, an additional punch-cutting station may be added, e.g., downstream from nip rollers 222, to form mid-line holes 156*a, b* through webs 190/198.

Alternative assembly techniques, such as heat sealing the webs of film together in series, may also be employed towards the manufacture of containers of the present invention. For instance, web 194 may be fused, through the application of heat sealing techniques, to folded web 198. Then, web 192 may be fused to web 194, thus yielding the flexible valve 120, as depicted in FIG. 20B, which is fused to folded web 198. Web 190 may then be fused to web 192 and web 198 concurrently or in series. The locations at which the various webs are fused to one another may be similar to the locations of the heat sealed joints 158*a, b* depicted in FIG. 20B, and the locations of the adhesive 162*a, b* depicted in FIG. 23A. If necessary or desired, certain areas of the various webs of film may be coated with a heat-resistant ink, e.g., to prevent any un-wanted sealing.

The support structure, e.g., support structure 14 or 137, can be constructed using a variety of different materials shaped into various geometries, as has already been discussed. The support structure can also be made much shorter, or longer, than may be implied by the descriptions above, so long as outward "second" forces are still applied to the flexible valve. Additionally, the support structure need not be of uniform thickness. For example, small deformities, or "bumps", made to the support structure itself can also be incorporated; such deformities may serve to restrict advancement of the inflatable containers at certain points along the track, thereby allowing the containers more time to inflate. These deformities can also be positioned to cause the flexible valve of a translating container to open prematurely; this would again serve to allow the containers more time for inflation. Also, while the support structures described above includes track arms which diverge and then converge, this need not be a pre-requisite for functionality. Indeed, the track arms can diverge without a subsequent convergence. If deformities are added to the track arms, or if the support structure is not of uniform thickness, or if the structure exerts lateral forces on the containers along its entire length, the track arms need not diverge or converge at all. The arms of the support structure can also be designed to have multiple converges and divergences. Additionally, while support structure 14 comprises two arms and support structure 137 comprises four arms, differing numbers of arms may employed, depending on the particular construction of the inflatable container being used with the support structure.

Figure 29:
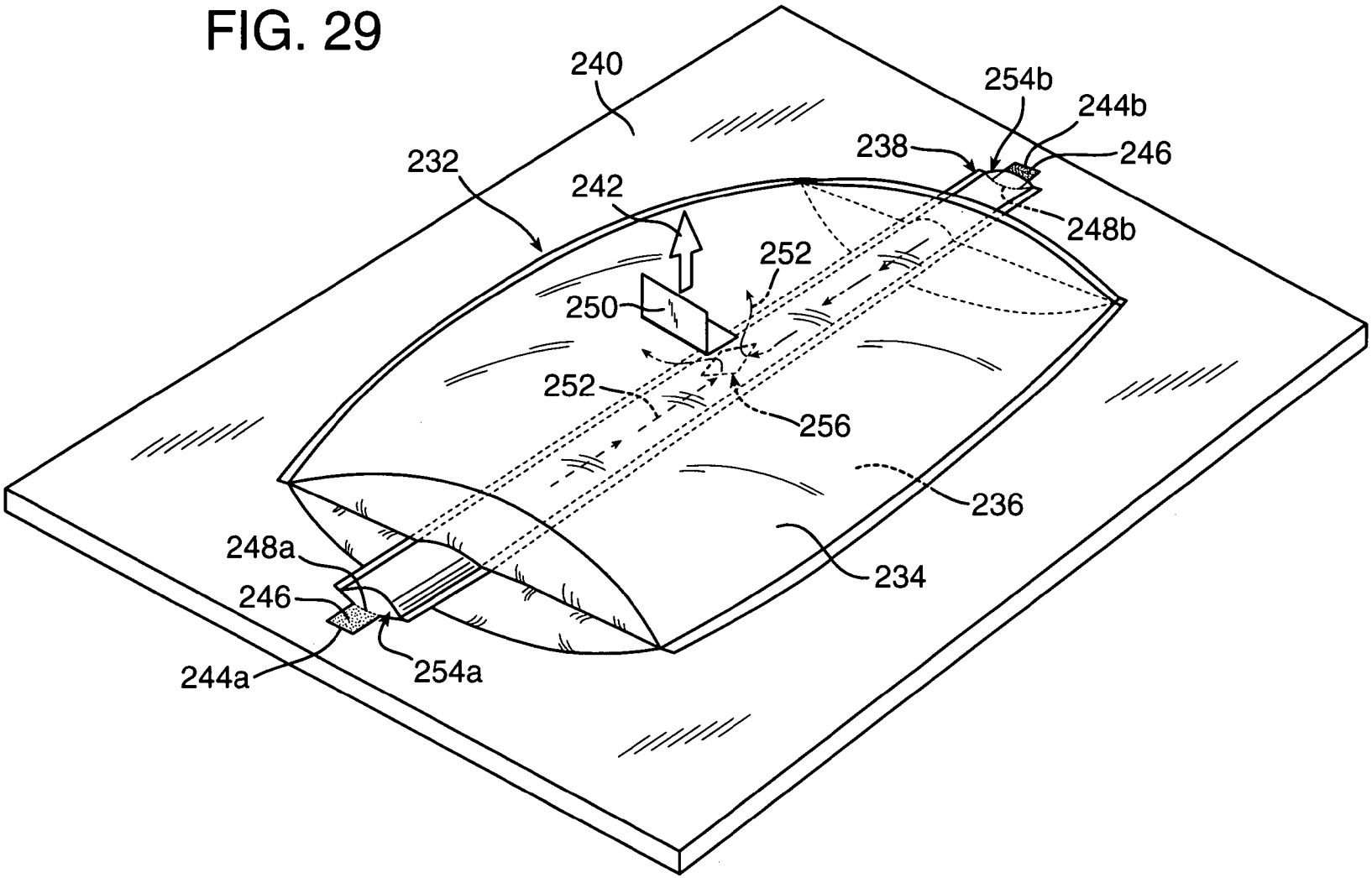
FIG. 29 is a perspective view of an alternative inflatable container in accordance with the present invention.

A further alternative embodiment of the invention is depicted in FIG. 29, wherein inflatable container 232 is shown. As with previously-described embodiments, inflatable container 232 generally includes a flexible housing 234 having an interior cavity 236, wherein the housing 234 is adapted to undergo at least one change in shape. Inflatable container 232 also includes a flexible valve 238.

Unlike the containers discussed infra in connection with previously-described embodiments of the invention, container 232 does not employ a guide track or other type of support structure to achieve inflation. Instead, flexible valve 238 is attached to flexible housing 234, and is adapted to be further attached to an object 240 external to housing 234, e.g., a planar surface as shown. There is no criticality with respect to object 240, other than that it allows flexible valve 238 to be attached thereto, e.g., via adhesive bonding, mechanical bonding, heat-welding, compression-holding, etc. Suitable examples for external object 240 include desks, tables, or walls; various planar or non-planar surfaces made of wood, metal, paper (e.g., fiber board or corrugated board), or plastic; brackets, frames, or other mounting apparata.

In some embodiments, flexible valve 238 may be adapted to be attached to external object 240 in a substantially non-movable manner as illustrated. This is in contrast to previously-described embodiments, e.g., inflatable containers 12, 135, wherein the containers/valves are movably mounted to a support structure.

In other embodiments, flexible valve 238 may be adapted to detach from external object 240 when a force 242 exerted on flexible housing 234 is greater than a predetermined amount. In this manner, the final inflated container may be removed for use. One way of providing such detachability is illustrated in FIG. 29, wherein flexible valve 238 may include at least one, e.g., two, tabs 244*a, b*, which are adapted to be attached to external object 240, e.g., via bond 246 between each tab and external object 240 as shown. Bond 246 may be, e.g., an adhesive-bond, a mechanical bond, a heat-weld, a compression-hold, etc. Tabs 244*a, b* may also be detachably affixed to flexible valve 238 such that at least a portion of each tab detaches from the valve when force 242 exerted on flexible housing 234 exceeds a predetermined amount. This may be accomplished, e.g., by providing a line of weakness 248*a*, b between each tab and valve 238. As illustrated, such lines of weakness 248*a, b* may comprise perforation lines, e.g., at the intersection of the tabs 244*a, b* and the flexible valve 238.

In this manner, depending on the material from which the valve and tabs are constructed and the nature of the lines of weakness 248*a, b*, e.g., the size and spacing of the perforations, such lines of weakness will tear once a pulling force, i.e., force 242, exceeds the tensile and/or tear strength of the material from which the tab/valve is constructed in the areas that separate the individual perforations.

As with previously-described embodiments, flexible valve 238 is adapted to undergo at least one change in shape to provide fluid communication between interior cavity 236 and the ambient environment in which said container is located, e.g., air. In this manner, when flexible valve 238 is attached to an external object, such as planar object 240, and a force 242 is exerted on flexible housing 234, e.g., manually via pull tab 250, the flexible housing 234 and flexible valve 238 each undergo a change in shape to draw fluid 252 from the ambient environment, through valve 238, and into interior cavity 236.

More specifically, when force 242 is exerted on flexible housing 234, e.g., manually via pull tab 250, the housing changes shape as shown. Simultaneously, because flexible valve 238 is attached to the flexible housing 234 and to external object 240, e.g., via tabs 244*a, b*, when force 242 is exerted on the housing, the valve also changes shape. This causes valve openings 254*a, b* to assume an open position as shown, which allows fluid 252 from the ambient environment, e.g., air, to be drawn into the valve openings 254*a, b*. The fluid 252 then flows through valve 238 and enters interior cavity 236 of flexible housing 234, e.g., via valve orifice 256, to inflate such housing as illustrated.

Flexible valve 238 may comprise a pair of juxtaposed film (valve) panels and be constructed in a similar manner to the construction of flexible valve 120 as described above, e.g., in connection with FIGS. 20A and 20B, except that 1) the heat-sealed joints 158*a, b* may extend the entire length of the valve so that valve flaps 163*a-d* are not created; 2) eyelets 121*a-d* are not necessary; and 3) tabs 244*a, b* and perforation lines 248*a, b* are added to the edges 161*b, d* of the second valve panel 148. Also, the first and second valve panels may be the same length. Flexible housing 234 may be identical to flexible housing 143 as described above, i.e., comprising a pair of juxtaposed film (housing) panels, etc., with flexible valve 238 being attached to the housing 234 similar to the attachment of flexible valve 120 to flexible housing 143.

Figure 30:
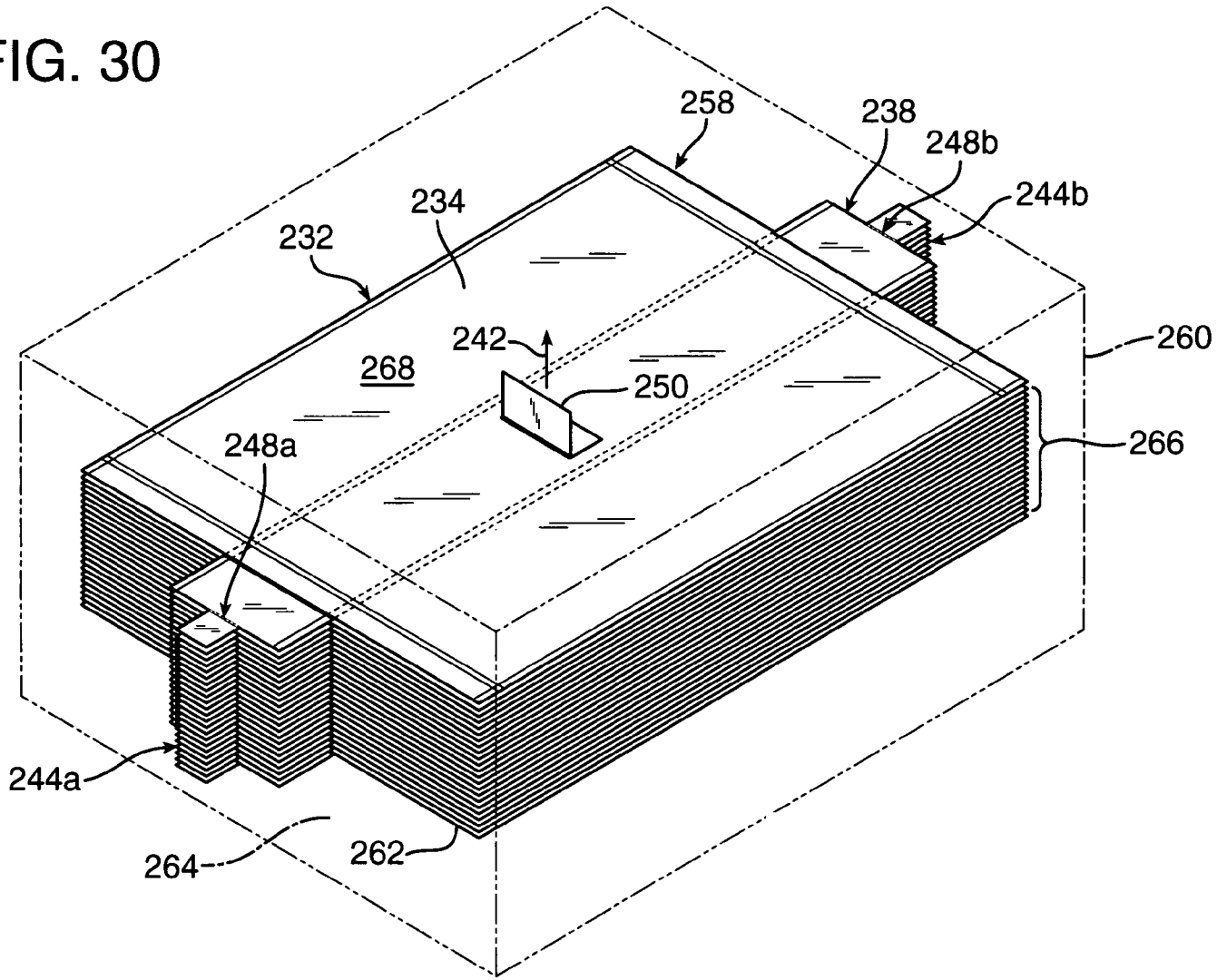
FIG. 30 is a perspective view of a stack of alternative inflatable containers as shown in FIG. 29.

Referring now to FIG. 30, a plurality, e.g., stack, 258 of inflatable containers 232 may be connected to one another and placed in a box 260 or other suitable receptacle. Tabs 244*a, b* of the bottom-most inflatable container 262 in the stack 258 may be joined to the bottom surface 264 of box 260, e.g., via adhesive or heat bonding as described above. Bottom surface 264 may thus serve as an "external object" for bottom-most container 262 as shown in FIG. 29. By stacking the cushions 232 such that the tabs are aligned, i.e., with respective tabs 244*a* and tabs 244*b* of all the cushions 232 in alignment as shown, the containers 232 may be attached to an adjacent container via tabs 244*a, b*, e.g., by adhesive-bonding or heat-welding. That is, tabs 244*a, b* may serve as a connector to attach the flexible valve 238 of one inflatable container to the flexible valve 238 of another inflatable container in the stack 258 of connected inflatable containers.

That is, with the exception of the bottom-most container 262 and top-most container 268 in the stack 258, all of the other containers 266 may be joined to a container directly above and directly below it in stack 258 via tabs 244*a, b*. Thus, each of containers 266 may have tab 244*a* thereof joined to (1) the tab 244*a* of the container immediately above it in the stack and to (2) the tab 244*a* immediately below it in the stack. Similarly, each of containers 266 may have tab 244*b* thereof joined to (1) the tab 244*b* of the container immediately above it in the stack and to (2) the tab 244*b* immediately below it in the stack. For the bottom-most container 262, tabs 244*a, b* thereof are attached to bottom surface 264 as noted above, and to respective tabs 244*a, b* of the container immediately above container 262 in the stack. Similarly, the tabs 244*a, b* of top-most container 268 are joined only to corresponding tabs 244*a, b* of the container immediately below it in the stack. With the exception of bottom-most container 262, i.e., for all of the other containers 266 and 268 in the stack, the container immediately below it in the stack is the "external object" to which the flexible valve 238 is attached.

Attachment of all tabs 244*a* and all tabs 244*b* may be accomplished in a single step, e.g., by stacking the containers as shown and then applying heat to each column of aligned tabs 244*a* and to each column of aligned tabs 244*b* to effect heat-welds between adjacent tabs. Alternatively, the tabs of each container may be adhered to the tabs of another container in series, e.g., adhesively or cohesively, one container at a time. This procedure may also be effectively accomplished through the application and activation of adhesives on the upper and lower surface area of the tabs of each container. A final assembly step involves adhering the valve tabs 244*a, b* of the bottom-most container 262 to the bottom surface 264 of box 260.

In use, a user may reach in to the top of box 260, (e.g., by removing a top cover (not shown)), grasp pull tab 250 of top-most container 268, and exert force 242. Because the flexible valve 238 of the top-most container 268 is attached to the valve of the container below it in the stack, e.g., via tabs 244*a, b*, force 242 causes both the flexible housing 234 and flexible valve 238 to change shape in such a way that flexible valve 238 opens and ambient fluid is drawn into the container via the valve as explained above. Following inflation, the user may separate the now inflated container 268 from the stack of un-inflated containers 266 and 262 by severing the connection of valve tabs 244*a,b* from the flexible valve 238, along the perforation lines 248*a, b*. This can be accomplished by a variety of methods, one of which is to simply pull the inflated container at an angle to box 260, thereby "tearing" the perforation lines 248*a, b*.

The inflatable containers and inflation mechanism as described herein may be advantageously employed to provide a reliable, lightweight, compact, and environmentally-friendly packaging void fill system, which does not necessitate the use of expensive inflation machinery. The present invention achieves such desirable characteristics in part by obviating the need for an external pressurized air source for the inflation of a flexible container. This fundamental advance over the related prior art has ramifications for industries besides those directly relating to protective packaging. A few such industries include those which produce floatation devices and air sampling apparata.

For instance, an inflatable floatation device based on the principles and structure of the present invention could be easily constructed by someone skilled in the art, as a floatation device is a natural and simple extension of the inflatable containers described herein. Such floatation device may necessitate an increased number of concurrently inflated containers, as well as an overall increased inflatable container size. Such alterations, however, are founded fully on the precepts and basic structure of the inflatable containers and inflation mechanism as described herein. This device, be it a raft, safety vest, oil-spill containment barrier or the like, could be rapidly inflated without requiring a power source such as electricity. In emergency situations in which a supply of electricity may be lacking, the benefits of such a device are readily apparent. Additionally, applying the teachings contained herein to a toy raft or the like would provide a way of partially inflating such devices as they are pulled from their boxes.

Self-inflating mattresses and pillows that incorporate the inflation technology of the present invention can be similarly constructed. As with the inflatable floatation devices just described, self-inflating bedding based on the present invention would not require electricity or lung power for inflation. Instead, it would fully or partially inflate when pulled along a guide track; as a convenience to the consumer, this guide track could easily be attached to the inside walls of the box in which the bedding is packaged.

Another example of an end-use application of the present invention is an air sampling device. The inflatable containers described in this application draw ambient fluids such as air directly into their interior. The air may then be contained within a given container by way of a self-sealing, flexible valve. These inflatable containers are essentially pulling samples of air into their confines, just as an air sampling pump does. And yet, when the inflatable containers are used as air sampling containers, they have the distinct advantage of directly sampling air without passing the air through an air pump. The sampled air is therefore not contaminated as it may be if it is passed through a pump. Similarly, the inflatable containers could also be used to gather samples of other fluids, such as water.

The novel, flexible valves as described herein could also be applied to other devices. In order to open most self-sealing valves, a foreign object, such as a rod, must be placed within the valve so as to force open its walls. Flexible valves in accordance with the present invention, however, can be opened through an applied lateral force. In devices in which reuse is desired, such as an inflatable envelope or cushion, a variation on the flexible valve could be incorporated so as to allow for easy deflation of the envelope. One end of the valve would be affixed to an internal surface of the container; then, when the user pulls on the valve, she imparts a lateral force on the valve structure. Consequently, the valve face containing the valve hole would deform and warp; and the valve would open and permit deflation. A similar application could be used in a number of other inflatable containers, such as foil self-sealing balloons.

Although the descriptions herein of the inflatable container system contain many specificities, these should not be construed as limiting the scope of the invention but as merely providing illustrations of some of the presently preferred embodiments of this invention. For example, the containers do not have to be connected to one another. The containers also do not have to be arranged into strictly vertical or horizontal rectangular stacks; the containers can instead be arranged into vertical spiral stacks, angled stacks, stacks which wind in a circular fashion, or any number of other varieties.

While two valve openings are illustrated in the described embodiments, one valve opening is sufficient for the successful inflation and operation of the inflatable container. Also, while the inflatable container as presented generally contains four "eyelets", which link the inflatable container to the support structure, two eyelets on one side of a container are sufficient to allow for the adequate inflation thereof. Additionally, if desired, the eyelets may be reinforced. This option would not likely be necessary, however, if repeated reuse of the containers is not an objective. Moreover, the leading eyelets 76*a* and 76*b* do not necessarily have to be formed on separate eyelet tabs 74*a* and 74*b*; the flexible valve can have eyelets made directly in its structure, thereby eliminating the eyelet tab components, e.g., as described above with respect to FIGS. 18-26.

The containers themselves can be formed in a variety of geometries, e.g., square, rectangular, elliptical, or any other number of polygonal shapes. Additional gusseted features—also known as expandable joints—could be integrated into the container structure; the gussets would allow for larger capacity containers, albeit at the price of possibly increased manufacturing complexity and cost. A self-inflating inflatable packing envelope based on the present invention can also easily be constructed; such a packing envelope could be made of two containers joined along three edges, thereby effectively creating a "container within a container" with an opening in which an article may be inserted and protected.

Un-inflated containers/cushions could also first be incorporated into a package and then inflated. In this case, the package could also be sealed before container inflation takes place, as long as a support structure can still access the eyelets of the packed un-inflated containers. The containers can also be dramatically increased in size; in this case, they may be referred to as dunnage bags. Of course, the support structure would also have to correspondingly increase in scale.

Moreover, throughout the description, the advantages of an inflatable container constructed entirely of flexible material have been discussed. However, rigid additions to the container, such as rigid eyelet reinforcements or rigid connectors, can certainly be made. Also, while inflatable containers constructed of a single, flexible material have been described in detail, a variety of composite materials can be substituted; and as mentioned, rigid components can be added if desired.

As may be apparent from the instant description, the extent to which the inflatable containers are inflated may be increased or decreased as desired by altering the geometry of several components. For instance, altering the shape of connector 82 can impact the inflation of connected containers. Other alterations, such as the placement of the leading eyelet tabs, the geometry of the support structure, and the width and shape of the flexible valve also can affect container inflation, although this list is by no means exhaustive.

Additionally, while the descriptions in this application have touted the benefits of an inflatable container system free of complicated machinery, rotating or reciprocating machinery which automates the pulling of the inflatable containers along the support structure may be employed if desired. If utilized, such machinery would simply replace the manual pulling and inflation of the containers, but the process would otherwise be fully within the scope of the present invention.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention.

What is claimed is:

1. An inflatable container, comprising:

a) a flexible housing having an interior cavity, said housing adapted to undergo at least one change in shape; and b) a flexible valve attached to said housing, said valve adapted to be further attached to an object external to said housing and to undergo at least one change in shape to provide fluid communication between (1) said interior cavity, and (2) the ambient environment in which said container is located, wherein, when said valve is attached to an external object and a force is exerted on said housing, said housing and said valve each undergo a change in shape to draw fluid from the ambient environment, through said valve, and into said interior cavity, and wherein said flexible valve detaches from the external object when the force exerted on said housing is above a predetermined amount.

2. The inflatable container of claim 1, wherein said flexible valve is adapted to be attached to the external object in a substantially non-movable manner.

3. The inflatable container of claim 1, wherein said flexible housing comprises a pair of juxtaposed film panels.

4. The inflatable container of claim 3, wherein said change in shape of said housing comprises movement of one film panel relative to the other film panel.

5. The inflatable container of claim 1, wherein said flexible valve comprises a pair of juxtaposed film panels.

6. The inflatable container of claim 5, wherein said change in shape of said valve comprises movement of one film panel relative to the other film panel to form a channel between said panels.

7. The inflatable container of claim 5, wherein at least one of said film panels of said flexible valve has an orifice therein; and said orifice assumes an open position upon exertion of said second force on said valve.

8. The inflatable container of claim 1, wherein said flexible valve has at least two openings that fluidly communicate with the ambient environment when said force is exerted on said housing.

9. The inflatable container of claim 1, wherein said flexible valve substantially prevents fluid communication between said interior cavity and the ambient environment in the absence of exertion of Said force.

* * * * *